US007789755B2

(12) United States Patent
Davis et al.

(10) Patent No.: US 7,789,755 B2
(45) Date of Patent: Sep. 7, 2010

(54) GAMING SYSTEM AND METHOD HAVING AWARD DISTRIBUTION USING SHARES

(75) Inventors: Dwayne A. Davis, Reno, NV (US); Michael M. Oberberger, Reno, NV (US)

(73) Assignee: IGT, Reno, NV (US)

( * ) Notice: Subject to any disclaimer, the term of this patent is extended or adjusted under 35 U.S.C. 154(b) by 403 days.

(21) Appl. No.: 11/556,940

(22) Filed: Nov. 6, 2006

(65) Prior Publication Data

US 2008/0108429 A1 May 8, 2008

(51) Int. Cl.
*A63F 9/24* (2006.01)

(52) U.S. Cl. ..... 463/26; 463/25; 463/27; 463/28; 463/42

(58) Field of Classification Search ..... 463/16–42
See application file for complete search history.

(56) References Cited

U.S. PATENT DOCUMENTS 2,068,379 A 1/1937 Frantz et al.
4,926,327 A 5/1990 Sidley
5,078,405 A 1/1992 Jones et al.
5,085,435 A 2/1992 Rossides
5,275,400 A 1/1994 Weingardt et al.
5,280,909 A 1/1994 Tracy
5,326,104 A 7/1994 Pease et al.
5,344,144 A 9/1994 Canon
5,393,057 A 2/1995 Marnell, II
5,511,781 A 4/1996 Wood et al.
5,542,669 A 8/1996 Charron et al.
5,564,700 A * 10/1996 Celona ..... 463/27
5,564,701 A 10/1996 Jones et al.
5,580,311 A 12/1996 Hoste, III
5,584,485 A 12/1996 SoRelle et al.
5,611,535 A 3/1997 Tiberio
5,620,182 A 4/1997 Rossides
5,645,486 A 7/1997 Nagao et al.
5,655,961 A 8/1997 Acres et al.
5,702,304 A 12/1997 Acres et al.
5,741,183 A 4/1998 Acres et al.
5,749,784 A 5/1998 Clapper, Jr.
5,752,882 A 5/1998 Acres et al.
5,766,076 A 6/1998 Pease et al.
5,772,509 A 6/1998 Weiss
5,779,547 A 7/1998 Byrne
5,779,549 A 7/1998 Walker et al.
5,816,918 A 10/1998 Kelly et al.
5,820,459 A 10/1998 Acres et al.
5,830,063 A 11/1998 Brune
5,836,817 A 11/1998 Acres et al.
5,851,149 A 12/1998 Para et al.
5,855,515 A 1/1999 Pease et al.
5,876,283 A 3/1999 Yen (Continued)

FOREIGN PATENT DOCUMENTS

EP 1 175 928 1/2002

(Continued)

OTHER PUBLICATIONS

Auction Fever Advertisement, written by Sierre Design Group, available prior to 2004.

(Continued)

*Primary Examiner*—Ronald Laneau
*Assistant Examiner*—Justin Myhr
(74) *Attorney, Agent, or Firm*—K&L Gates LLP

(57) ABSTRACT

A gaming system including a plurality of gaming devices each having a base game and a bonus pool available to each of the plurality of gaming devices. A processor programmed to provide shares of the bonus pool to one or more actively played gaming device of the plurality of gaming devices and to distribute the bonus pool to each eligible gaming device according to an amount of the bonus pool and each gaming device's obtained shares.

20 Claims, 9 Drawing Sheets

U.S. PATENT DOCUMENTS 5,876,284 A 3/1999 Acres et al.
5,885,158 A 3/1999 Torango et al.
5,890,963 A 4/1999 Potter et al.
5,947,820 A 9/1999 Morro et al.
5,951,011 A 9/1999 Cherry
5,957,775 A 9/1999 Goldman
5,997,002 A 12/1999 Kelly et al.
6,001,016 A 12/1999 Walker et al.
6,015,344 A 1/2000 Beltran
6,056,289 A 5/2000 Clapper, Jr.
6,065,752 A 5/2000 Weiss
6,077,162 A 6/2000 Weiss
6,089,980 A * 7/2000 Gauselmann ..... 463/27
6,110,041 A 8/2000 Walker et al.
6,142,872 A 11/2000 Walker et al.
6,162,122 A 12/2000 Acres et al.
6,206,782 B1 3/2001 Walker et al.
6,210,275 B1 4/2001 Olsen
6,224,482 B1 5/2001 Bennett
6,231,445 B1 5/2001 Acres
6,241,608 B1 6/2001 Torango
6,244,958 B1 6/2001 Acres
6,254,483 B1 7/2001 Acres
6,257,981 B1 7/2001 Acres et al.
6,296,569 B1 10/2001 Acres
6,311,976 B1 11/2001 Yoseloff et al.
6,312,332 B1 11/2001 Walker et al.
6,312,333 B1 11/2001 Acres
6,319,122 B1 11/2001 Packes, Jr. et al.
6,319,125 B1 11/2001 Acres
6,336,862 B1 1/2002 Brune
6,364,768 B1 4/2002 Acres et al.
6,371,852 B1 4/2002 Acres
6,375,567 B1 4/2002 Acres
6,375,568 B1 4/2002 Roffman et al.
6,375,569 B1 4/2002 Acres
6,431,983 B2 8/2002 Acres
6,435,511 B1 8/2002 Vancura et al.
6,565,434 B1 5/2003 Acres
6,575,832 B1 6/2003 Manfredi et al.
6,592,459 B2 7/2003 Parra et al.
6,592,460 B2 7/2003 Torango
6,607,438 B2 8/2003 Baerlocher et al.
6,607,441 B1 8/2003 Acres
6,620,046 B2 9/2003 Rowe
6,626,758 B1 9/2003 Parham et al.
6,632,141 B2 10/2003 Webb et al.
6,648,753 B1 11/2003 Tracy et al.
6,652,378 B2 11/2003 Cannon et al.
6,656,047 B1 12/2003 Tarantino et al.
6,676,512 B2 1/2004 Fong et al.
6,692,354 B2 2/2004 Tracy et al.
6,709,330 B1 3/2004 Klein et al.
6,712,697 B2 3/2004 Acres
6,749,510 B2 6/2004 Giobbi
6,758,748 B2 7/2004 Byrne
6,800,030 B2 10/2004 Acres
6,814,664 B2 11/2004 Baerlocher et al.
6,832,958 B2 12/2004 Acres et al.
6,835,132 B2 12/2004 Bennett
6,837,788 B2 1/2005 Cannon
6,869,076 B1 3/2005 Moore et al.
6,869,361 B2 3/2005 Sharpless et al.
6,887,154 B1 5/2005 Luciano, Jr. et al.
6,910,964 B2 6/2005 Acres
RE38,812 E 10/2005 Acres et al.
7,018,292 B2 3/2006 Tracy et al.
7,025,674 B2 4/2006 Adams et al.
7,040,982 B1 5/2006 Jarvis et al.
7,056,215 B1 6/2006 Olive
7,077,746 B2 7/2006 Torango
7,169,041 B2 1/2007 Tessmer et al.
7,302,412 B1 * 11/2007 Speck ..... 705/37
7,513,828 B2 4/2009 Nguyen et al.
2001/0049298 A1 * 12/2001 Bennett ..... 463/16
2001/0055990 A1 12/2001 Acres
2002/0014821 A1 2/2002 Kobayashi et al.
2002/0138594 A1 9/2002 Rowe
2002/0151342 A1 10/2002 Joseph et al.
2002/0177483 A1 11/2002 Cannon
2002/0183105 A1 12/2002 Cannon et al.
2003/0027625 A1 2/2003 Rowe
2003/0036430 A1 2/2003 Cannon
2003/0242297 2/2003 Rowe
2003/0045350 A1 3/2003 Baerlocher et al.
2003/0060266 A1 3/2003 Baerlocher
2003/0060279 A1 3/2003 Torango
2003/0090063 A1 5/2003 Jarvis et al.
2003/0092484 A1 5/2003 Schneider et al.
2003/0144965 A1 7/2003 Prasad et al.
2003/0186733 A1 10/2003 Wolf et al.
2003/0211880 A1 11/2003 Locke
2003/0222402 A1 12/2003 Olive
2003/0228904 A1 12/2003 Acres et al.
2003/0236116 A1 12/2003 Marks et al.
2004/0009811 A1 1/2004 Torango
2004/0072615 A1 4/2004 Maya et al.
2004/0229700 A1 * 11/2004 Cannon et al. ..... 463/42
2004/0242297 A1 12/2004 Walker
2005/0020340 A1 1/2005 Cannon
2005/0020342 A1 1/2005 Palmer et al.
2005/0032573 A1 2/2005 Acres et al.
2005/0043088 A1 2/2005 Nguyen et al.
2005/0086143 A1 * 4/2005 Vlazny et al. ..... 705/35
2005/0119047 A1 6/2005 Olive
2005/0143168 A1 6/2005 Torango
2005/0148380 A1 * 7/2005 Cannon et al. ..... 463/16
2005/0153767 A1 7/2005 Gauselmann
2005/0176488 A1 8/2005 Olive
2005/0209004 A1 9/2005 Torango
2005/0239542 A1 10/2005 Olsen
2006/0003829 A1 1/2006 Thomas
2006/0035705 A1 2/2006 Jordan
2006/0040723 A1 2/2006 Baerlocher et al.
2006/0040732 A1 2/2006 Baerlocher et al.
2006/0040733 A1 2/2006 Baerlocher et al.
2006/0040734 A1 2/2006 Baerlocher et al.
2006/0040736 A1 2/2006 Baerlocher et al.
2006/0068893 A1 * 3/2006 Jaffe et al. ..... 463/20
2006/0119034 A1 * 6/2006 Bozeman ..... 273/138.1
2006/0247015 A1 * 11/2006 Walker et al. ..... 463/20
2007/0105613 A1 5/2007 Adams et al.

FOREIGN PATENT DOCUMENTS

EP 1 298 609 4/2003
WO WO 00/32286 6/2000
WO WO 03/049054 6/2003
WO WO 2005/015826 2/2005
WO WO2007091257 8/2007

OTHER PUBLICATIONS

Gold Exchange Advertisement, written by Bally, available prior to Nov. 2006.

* cited by examiner

FIG. 5
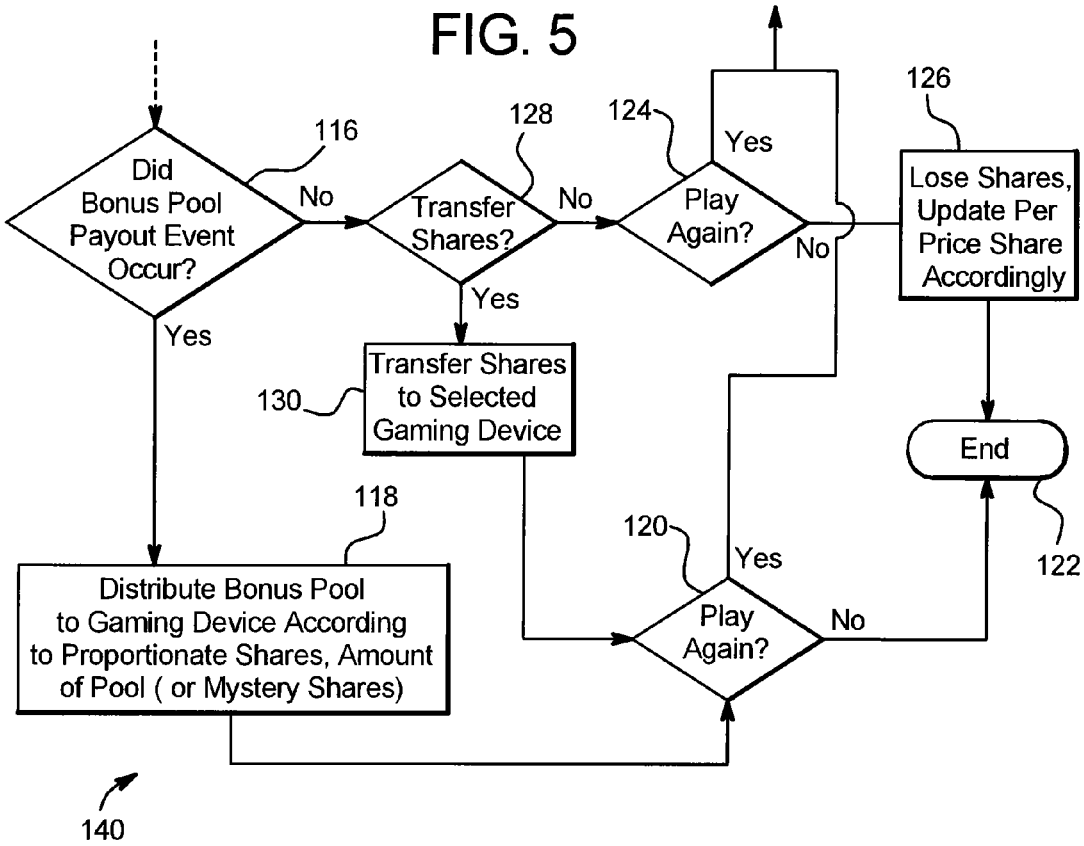
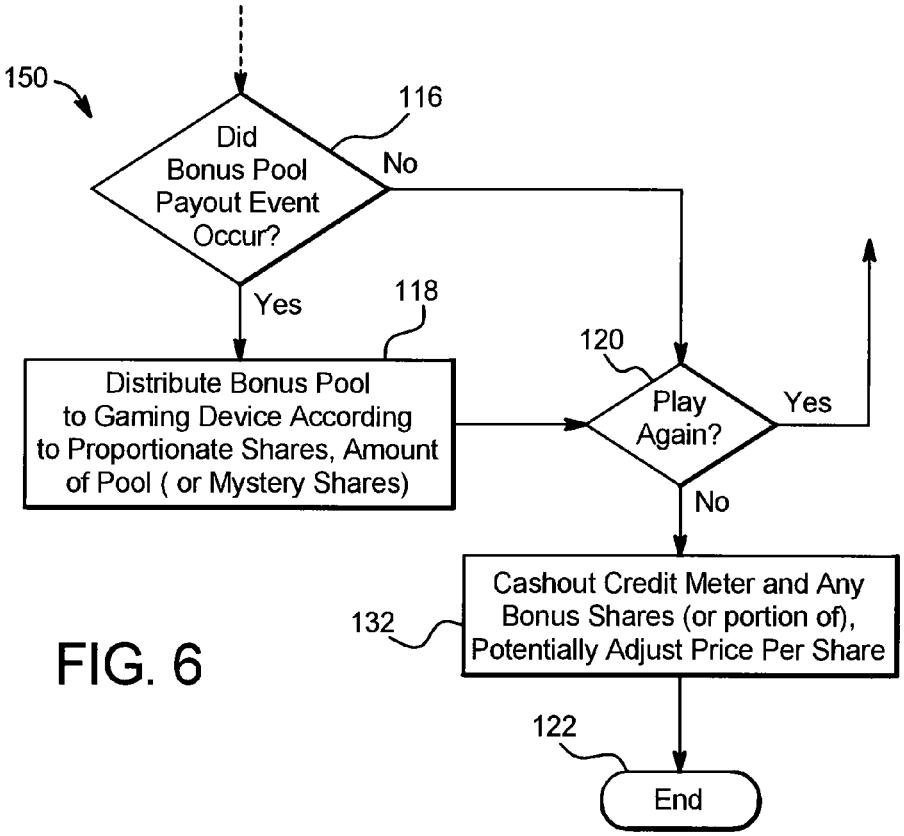
FIG. 6

GAMING SYSTEM AND METHOD HAVING AWARD DISTRIBUTION USING SHARES

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines that provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations that are less likely to occur usually provide higher awards.

In such known gaming machines, the amount of the wager made on the base game by the player may vary. For instance, the gaming machine may allow the player to wager a minimum number of credits, such as one credit (e.g., one penny, nickel, dime, quarter or dollar) up to a maximum number of credits, such as five credits. The player may make this wager a single time or multiple times in a single play of a primary game. For instance, a slot game may have one or more paylines and the slot game may allow the player to make a wager on each payline in a single play of the primary game. Slot games with 1, 3, 5, 9, 15 and 25 lines are widely commercially available. Thus, it is known that a gaming machine, such as a slot game, may allow players to make wagers of substantially different amounts on each play of the primary or base game ranging, for example, from one credit up to 125 credits (e.g., five credits on each of 25 separate paylines). This is also true for other wagering games, such as video draw poker, where players can wager one or more credits on each hand and where multiple hands can be played simultaneously. Different players play at substantially different wagering amounts or levels and at substantially different rates of play.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machines generally indicates this to the player through one or more visual and/or audio output devices, such as the reels, lights, speakers, video screens, etc. Part of the enjoyment and excitement of playing certain gaming machines is the occurrence of the secondary or bonus game (even before the player knows how much the bonus award will be). In other words, obtaining a bonus award is part of the enjoyment and excitement for players.

Progressive awards associated with gaming machines are also known. In one form, a progressive award is an award amount which includes an initial amount funded by a casino and an additional amount funded through a portion of each wager made on the progressive gaming machine. For example, 1% to 5% of each wager placed on the primary game of the gaming machine associated with the progressive award may be allocated to the progressive award or progressive award fund. The progressive award grows in value as more players play the gaming machine and thus portions of these players' wagers are allocated to the progressive award. When a player obtains a winning symbol or symbol combination which results in the progressive award, the accumulated progressive award is provided to the player. After the progressive award is provided to the player, the amount of the next progressive award is reset to the initial value and a portion of each subsequent wager on a gaming machine associated with the progressive is allocated to the next progressive award as described above.

A progressive award may be associated with a single gaming machine or multiple gaming machines which each contribute portions of the progressive award. The multiple gaming machines may be in the same bank of machines, in the same casino or gaming establishment (usually through a local area network ("LAN")) or in two or more different casinos or gaming establishments (usually through a wide area network ("WAN")). Such progressive awards are sometimes called local area progressives ("LAP") and wide area progressives ("WAP"), respectively.

Regardless of the type of progressive award, known games typically require the player to play the maximum bet to be eligible to win a large progressive award. Many players who are not willing to wager such an amount, or consistently willing to wager such an amount are thus excluded from having an opportunity to win such large progressive awards.

Other known multi-payline slot machines enable the player to win other predetermined awards when the player plays or activates all the paylines of the gaming device. On a slot machine having five reels and three displayed symbols per reel, it is not uncommon for the machine to have five, nine or fifteen different paylines. The gaming machines often require the player to bet the lines sequentially, i.e., one, two, three as opposed to payline one, payline three, payline eight, and most machines require the same bet (or the maximum bet) to be placed on each payline. Many players are again unwilling to make such wagers on a consistent basis and thus are excluded from having an opportunity to win a multi-payline jackpot in these gaming machine.

Accordingly, there is a need for a new gaming system that provides awards based on several different factors such as how much a player plays, how many other players are playing, and how much players are wagering.

SUMMARY

One embodiment of the gaming system and method described herein links a plurality of gaming devices, each having the same or different base wagering game. In one embodiment, as players play the gaming devices, (a) a portion of each wager is dedicated to increasing the overall value or amount of a designated award or bonus pool, (b) the players are periodically awarded shares representing portions of the designated award or bonus pool based on when share distribution triggering events occur, and (c) the players are provided portions of the designated award or bonus pool based on their accumulated shares when an award distribution event occurs.

In various embodiments, shares are awarded or distributed to the player based on one or more different factors or share distribution events such as: (a) number of games played, (b) amount wagered per game, (c) total amounts waged during designated time periods, (d) amounts of time played, (e) primary or base game events or outcomes generated such as certain designated symbols or symbol combinations occurring in a play of a game, (f) secondary or bonus game events or outcomes generated, (g) events associated with a player's status (determined through a suitable player tracking system), (h) a random determination by the central controller, (i) a random determination at the gaming machine, (j) one or more side wagers placed; (k) an award amount won; (l) a comparison of a player's winning outcomes to losing outcomes; (m) a denomination played; (n) a game type played; (o) a player's non-game play history; (p) a player's table game activity; or (q) any combination thereof.

In one embodiment, the gaming system displays and enables each player to see the number of shares that player has, the value of each share at each point in time, the total number of shares outstanding and the total value of all shares (which in one embodiment is the overall value or amount of the designated award or bonus pool). That is, the gaming system displays any suitable information to the player to convey to the player that as the player continues to play a gaming device in the gaming system, the player's value of each of their existing shares may increase because certain other players stop playing gaming devices and forfeit their shares. In one embodiment, this information for each player is viewable by all of the players. In an alternative embodiment, each player can only see their amount of shares.

In one embodiment, the value of each share is the designated award or bonus pool amount (at each point in time) divided by the total number of outstanding shares (at that point in time). In other words, at any given point in time, the total number of outstanding shares and the total pool amount dictates each share value. In various embodiments, (i) shares are added to the gaming system, (ii) the designated award or bonus amount continuously increases, and/or (iii) shares are potentially removed from the gaming system (via cash outs); thus the number and value of each share will change fairly often over time depending on the level of gaming activity and these changes may be displayed to the players in any suitable manner. It should be appreciated that as described herein: an outstanding share is a share provided to a player and currently in existence (such as, but not limited to: a share currently held by a player at a gaming device in the gaming system; a share currently stored in an account associated with a player; or a share currently stored in an account associated with the gaming system); a forfeited share is a share that is no longer outstanding and not currently in existence (such as but not limited to: a share not currently held by a player at a gaming device in the gaming system; a share not currently stored in an account associated with a player; or a share not currently stored in an account associated with the gaming system); and the total number of distributed shares is the total number of outstanding shares plus the total number of forfeited shares.

In various alternative embodiments, the gaming system pays out the designated award or bonus pool based on the outstanding shares accumulated by the players when one or more of the following events occur: (i) an occurrence of a designated primary or base game event or outcome (such as a designated symbol or symbol combination or one of the gaming machines achieving the top award); (ii) an occurrence of a designated secondary or bonus game event or outcome; (ii) a total designated wager amount are played collectively on the gaming machines in the gaming system; (iii) a set time of day; (iv) a random or mystery determination; (v) a predetermined event; (vi) a comparison of a player's winning outcomes to losing outcomes; (vii) a player reaching a number of accumulated shares threshold amount; (viii) a player reaching a total share value threshold amount; (ix) an operator determined event; or (x) any combination thereof.

In one embodiment, upon payout (which is triggered in any suitable manner), the gaming system divides the designated award or bonus pool amount by the total number of outstanding shares in the gaming system. Each player is awarded a personal award or bonus based on their accumulated number of shares.

At certain points in time, it is likely that the total pool amount is not evenly divisible by the number of outstanding shares. It should be appreciated that any suitable mechanism may be employed to account for this possible discrepancy. In one such embodiment, one or more remainders are utilized which are applied to one or more future award pools. In another such embodiment, assuming a total dollar amount to equal a total credit or coin amount such as one coin equals one dollar, payouts will need to be rounded or need to be made in fractions of a credit or in cents on a dollar. Accordingly, in one embodiment a credit meter that reads in hundredths or thousandths of a credit can be provided along with an electronic payout mechanism (e.g., ticket), which facilitates payouts in fractions of a credit. This enables the credits to be rounded to the nearest hundredth of a credit which enables payouts to be made in dollars and cents.

In one embodiment, shares can be accumulated as long as the player continues playing a single gaming machine. In another embodiment, the player can accumulate shares through play of multiple gaming machines such as over a designated time period. In different alternatives of this embodiment, when the player stops playing: (a) the player loses their shares; (b) the player can cash in some or all of their shares for an award; (c) the player can transfer some or all of their shares to another player; (d) the player can keep some or all of their shares in association with a player tracking system; (e) the player can store some or all of their shares and earn positive interest on their stored shares; (f) the player can store some or all of their shares but gradually lose one or more shares over a designated period of time; (g) the player can store some or all of their shares but lose one or more shares at a designated point in time; (h) the player can store some or all of their shares but the value associated with these shares gradually decrease over a designated period of time (such as via a negative interest rate); (i) the player can store some or all of their shares but the value associated with these shares decrease at a designated point in time; or (j) any combination thereof.

More specifically, in one such embodiment, when a player stops playing a gaming machine (determined via a cashout, removal of a player tracking card, or by a period of inactivity on the gaming device), the shares the player has accumulated are lost. In this manner, shares are only valid on an active gaming device in certain embodiments. If the shares are lost, meaning they are no longer part of the outstanding shares in the gaming system, the total value for all remaining outstanding shares increases. It should be appreciated that this embodiment provides increased incentives for players to continue playing once they have accumulated shares.

More specifically, in another such embodiment, when a player cashes out, the player is enabled to redeem his or her shares. In this embodiment, the gaming system pays out the total value of the shares or some percentage of the value of the shares. In different embodiments, when a player cashes out one or more shares, the shares are returned to the gaming system and the gaming system provides the player with one or more credits, one or more player tracking points and/or one or more promotional credits. It should be appreciated that a percentage share payout leads to a share price increase for the remaining players.

In one example alternative embodiment, the gaming system enables players to give some or all of their shares to other players. In this embodiment, the gaming system enables a first player to cause a transfer of one or more of the first player's shares to a second player. In another example alternative embodiment, the gaming system enables players to sell some or all of their shares to other players. In this embodiment, the gaming system enables a first player to cause a transfer of one or more of the first player's shares to a second player in exchange for the second player to cause a transfer of one or more of the second player's credits to the first player. In different embodiments, the gaming system enables one player to transfer one or more credits to another player via: (i) an auction; (ii) a printing out of the number of transferred shares on a ticket and an exchange of the printed ticket; (iii) an association of the number of transferred shares on a rewritable card and an exchange of the card; (iv) the gaming system network (utilizing one or more service windows and a suitable identifier); (v) the player tracking system; (vi) any combination thereof; or (vii) any other suitable manner. In one such embodiment, the gaming system enables one or more players to pay game credits for some or all of the transferor's shares (such as at a fraction of the going share price or according to an auction). In this embodiment, the transfer happens through the gaming system and enables players to cashout at least portions of their shares or exchange shares for credits for further gaming. In one such embodiment, for each share sold by a player to another player, the gaming establishment charges a commission or fee. It should be appreciated that players who buy shares increase their winning potential if the bonus is triggered.

In various embodiments, the value of the share sold or cashed out by a player may be displayed to the players or not displayed to the players.

In further embodiments, the gaming system is configured to provide mystery shares. The distribution of mystery shares is randomized in one embodiment, and the value or number of the mystery share varies and is revealed when the award or bonus is provided to the player. This provides even more excitement to the bonus payout, e.g., the mystery shares can pay out at a higher rate than a normal share. Mystery shares are funded by a separate pool in one embodiment. The mystery shares are colored coded in one example embodiment. For instance, in one example embodiment, gold shares are worth more than copper shares. Mystery shares can also be used to reward the gaming device that has actually triggered the bonus pool payout, wherein the pool benefits all active gaming devices.

In another embodiment, the gaming system awards dividends or a certain amount per share to the players based on their number of accumulates shares at a point in time. If the bonus pool is structured to hit relatively infrequently, the dividends can be used as more frequent player awards. In one embodiment, dividends are factored into the base game paytable in one embodiment and do not effect the bonus pool amount.

In other embodiments, the award or bonus pool is alternatively funded through one or more of the following sources: (a) from the paytables of the gaming machines (e.g., different combinations generated in different games fund the award pool different amounts); (b) from marketing dollars (e.g., based on a randomly determined amount or based on the number of players currently playing gaming devices in the gaming system); (c) from side wagers required to obtain shares (which, in one embodiment, cause the value associated with one or more outstanding shares to decrease); or (d) any combination thereof.

It is therefore an advantage of the present disclosure to provide a gaming system and method which provides awards based on shares.

Additional features and advantages are described herein, and will be apparent from, the following Detailed Description and the figures.

BRIEF DESCRIPTION OF THE FIGURES

FIG. 5 is a schematic block diagram of an alternative sequence of operation for a gaming system having award distribution using shares according to the present disclosure.

FIG. 6 is a schematic block diagram of another alternative sequence of operation for a gaming system having award distribution using shares according to the present disclosure.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
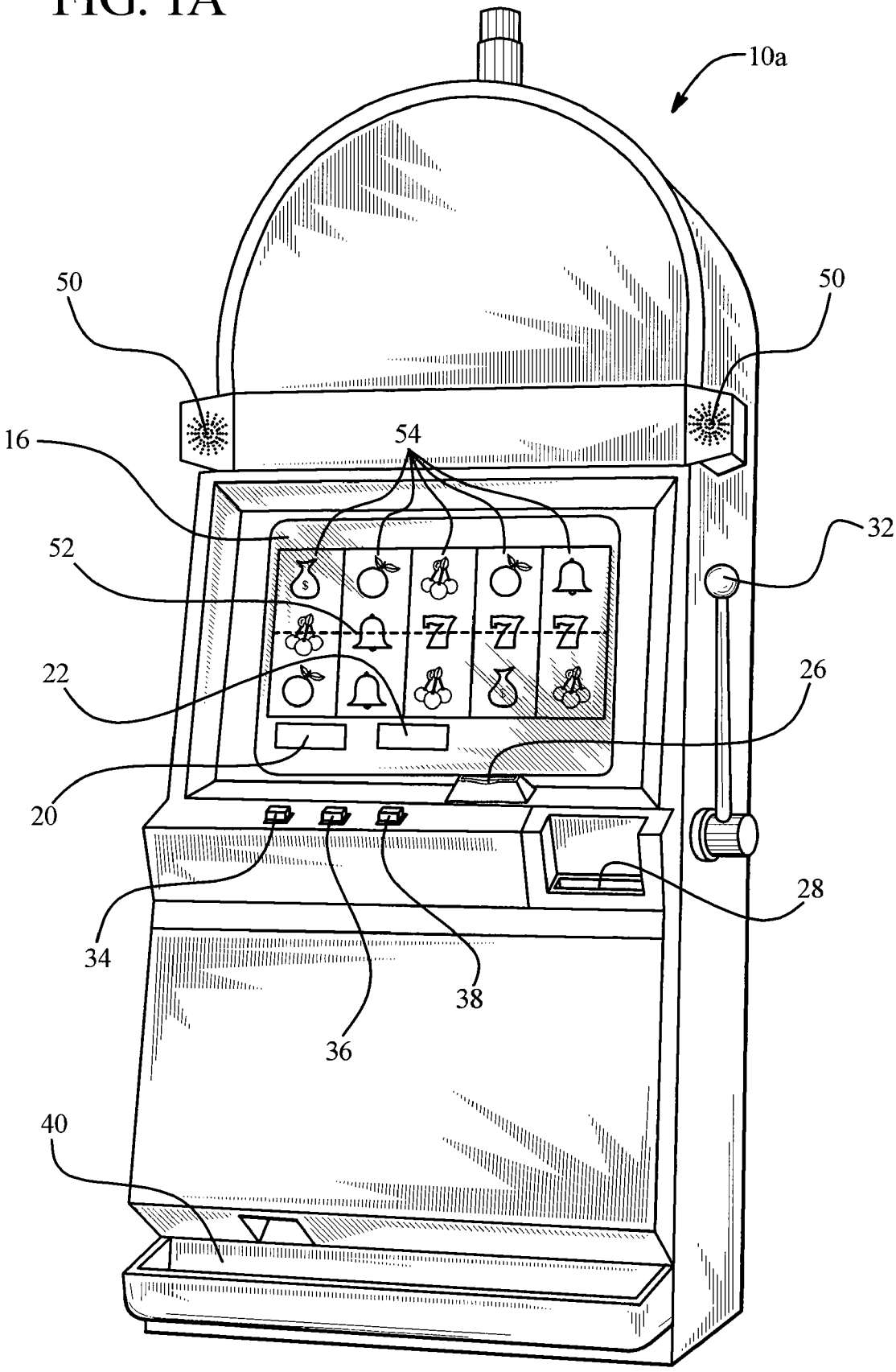
FIG. 1A is a front perspective view of one embodiment of the gaming device of the present disclosure.
Figure 1B:
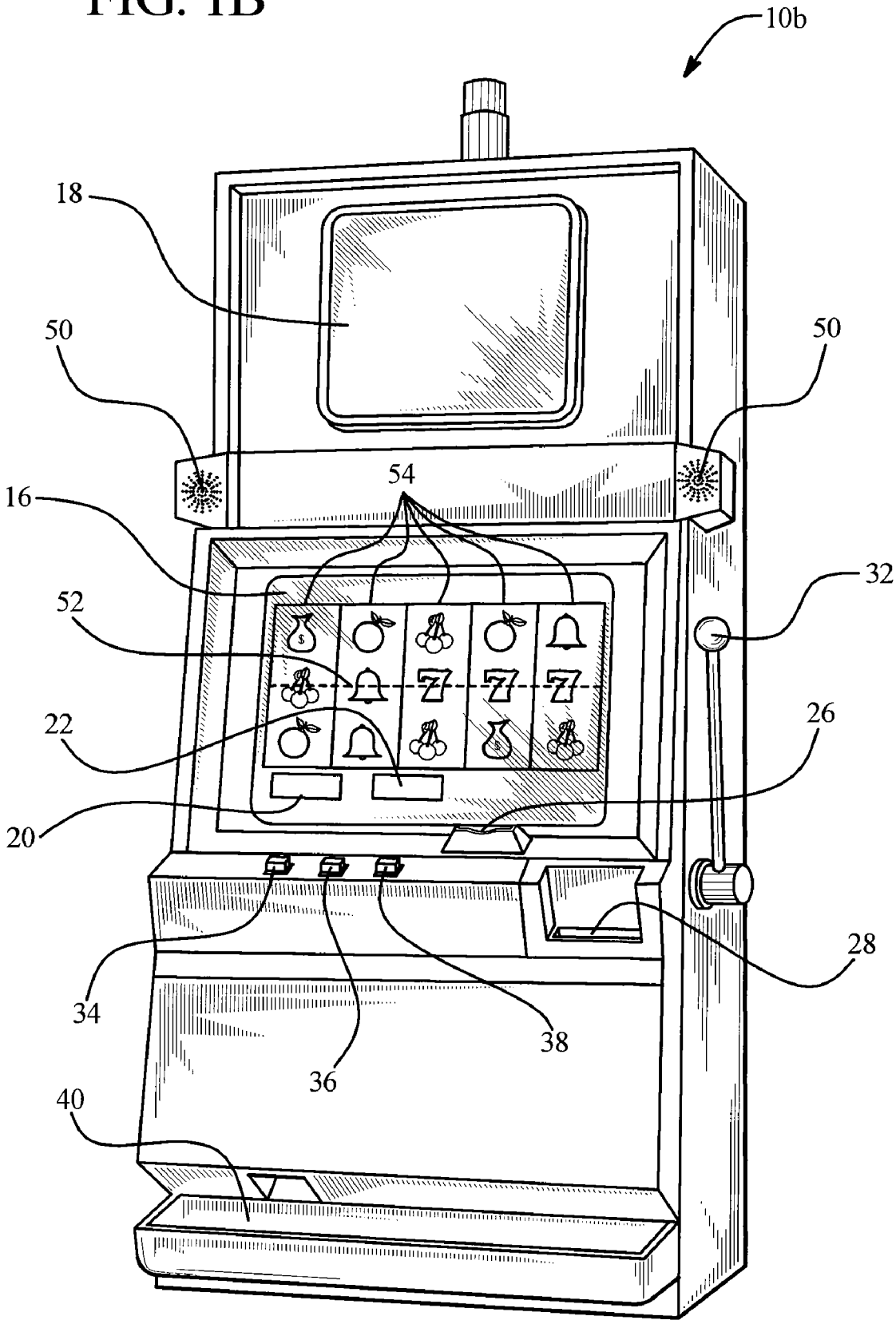
FIG. 1B is a front perspective view of another embodiment of the gaming device of the present disclosure.

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. Gaming device 10 may be positioned on a base or stand or can be configured as a pub-style table-top game (not shown) which a player can operate preferably while sitting. As illustrated by the different configurations shown in FIGS. 1A and 1B, gaming device 10 may have varying cabinet and display configurations.

Figure 2A:
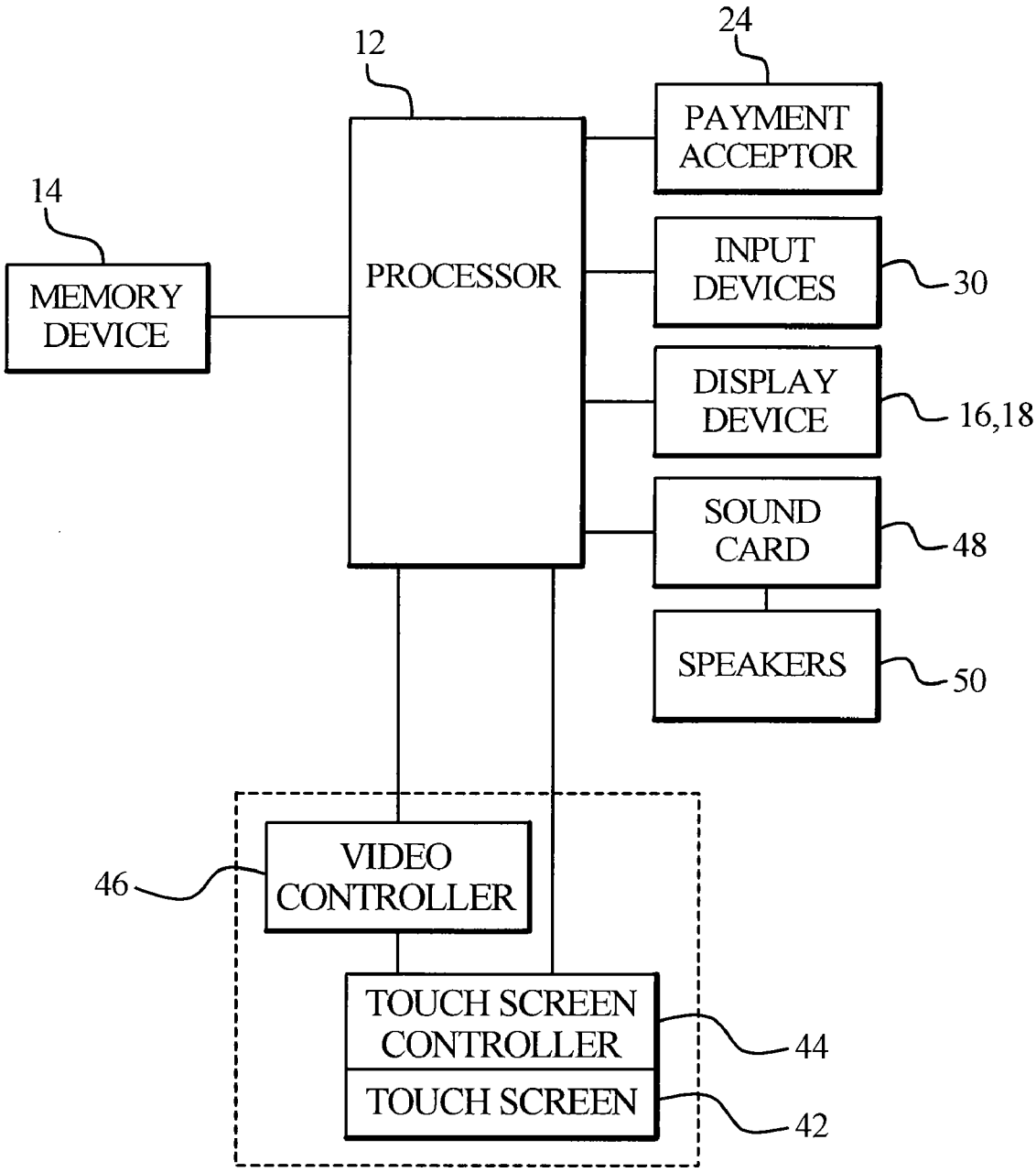
FIG. 2A is a schematic block diagram of one embodiment of an electronic configuration for one of the gaming devices of the present disclosure.

In one embodiment, as illustrated in FIG. 2A, the gaming device preferably includes at least one processor 12, such as a microprocessor, a microcontroller-based platform, a suitable integrated circuit or one or more application-specific integrated circuits ("ASIC's"). Processor 12 is in communication with or operable to access or to exchange signals with at least one data storage or memory device 14. In one embodiment, processor 12 and the memory device 14 reside within the cabinet of the gaming device. Memory device 14 stores program code and instructions, executable by processor 12, to control the gaming device. Memory device 14 also stores other data such as image data, event data, player input data, random or pseudo-random number generators, pay-table data or information and applicable game rules that relate to the play of the gaming device. In one embodiment, the memory device 14 includes random access memory ("RAM"), which can include non-volatile RAM ("NVRAM"), magnetic RAM ("MRAM"), ferroelectric RAM ("FeRAM") and other forms as commonly understood in the gaming industry. In one embodiment, the memory device includes read only memory ("ROM"). In memory device 14 includes alternative flash memory and/or EEPROM (electrically erasable programmable read only memory). Any other suitable magnetic, optical and/or semiconductor memory may operate in conjunction with gaming device 10.

In one embodiment, part or all of the program code and/or operating data described above can be stored in a detachable or removable memory device 14, including, but not limited to, a suitable cartridge, disk, CD ROM, DVD or USB memory device. In other embodiments, part or all of the program code and/or operating data described above is downloaded to the memory device through a suitable network.

An operator or a player can use such a removable memory device in a desktop computer, a laptop personal computer, a personal digital assistant ("PDA"), portable computing device, or other computerized platform to implement the present disclosure. In one embodiment, the gaming device or gaming machine 10 is operable over a wireless network, such as part of a wireless gaming system. Here gaming machine 10 may be a hand held device, a mobile device or any other suitable wireless device that enables a player to play any suitable game at a variety of different locations. It should be appreciated that gaming device or gaming machine 10 may be a device that has obtained approval from a regulatory gaming commission or a device that has not obtained approval from a regulatory gaming commission. It should also be appreciated that the processor 12 and memory device 14 may be collectively referred to herein as a "computer" or "controller."

In one embodiment, as discussed in more detail below, the gaming device 10 randomly generates awards and/or other game outcomes based on probability data. This random determination is provided through utilization of a random number generator ("RNG"), such as a true random number generator, a pseudo random number generator or other suitable randomization process. In one embodiment, each award or other game outcome is associated with a probability and gaming device 10 generates the award or other game outcome to be provided to the player based on the associated probabilities. Here, since gaming device 10 generates outcomes randomly or based upon one or more probability calculations, there is no certainty that gaming device 10 will ever provide the player with any specific award or other game outcome.

In another embodiment, as discussed in more detail below, gaming device 10 employs a predetermined or finite set or pool of awards or other game outcomes. Here, as each award or other game outcome is provided to the player, the gaming device 10 flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at gaming device 10, gaming device 10 enrolls in a bingo game. Here, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

As illustrated in FIG. 2A, the gaming device includes one or more display devices controlled by the processor. The display devices connected to or mounted to the cabinet of the gaming device. The embodiment shown in FIG. 1A includes a central display device 16 which displays a primary game. Display device 10 may also display any suitable secondary game associated with the primary game as well as information relating to the primary or secondary game. Alternative gaming machine 10 shown in FIG. 1B includes a central display device 16 and an upper display device 18. Upper display device 10 may display the primary game, any suitable secondary game associated or not associated with the primary game and/or information relating to the primary or secondary game. Display devices may also serve as digital glass operable to advertise games or other aspects of the gaming establishment. As seen in FIGS. 1A and 1B, in one embodiment, gaming device 10 includes a credit display 20 which displays a player's current number of credits, cash, account balance or the equivalent. In one embodiment, gaming device includes a bet display 22 which displays a player's amount wagered.

In another embodiment, at least one display device may be a mobile display device, such as a PDA or tablet PC, that enables play of at least a portion of the primary or secondary game at a location remote from the gaming device.

Display devices 16 and 18 may include, without limitation, a monitor, a television display, a plasma display, a liquid crystal display ("LCD") a display based on light emitting diodes ("LED"), a display based on a plurality of organic light-emitting diodes ("OLEDs"), a display based on polymer light-emitting diodes ("PLEDs"), a display based on a plurality of surface-conduction electron-emitters ("SEDs"), a display including a projected and/or reflected image or any other suitable electronic device or display mechanism. As described in more detail below, the display device 16 and 18 includes a touch screen with an associated touch screen controller. Display devices 16 and 18 may be of any suitable size and configuration, such as a square, a rectangle or an elongated rectangle.

Display devices 16 and 18 of gaming device 10 are configured to display at least one and likely a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In an alternative embodiment, the symbols, images and indicia displayed on or of the display device 16 and 18 may be in mechanical form. That is, display device 16 and 18 may include any electromechanical device, such as one or more mechanical objects, such as one or more rotatable wheels, reels or dice, configured to display at least one or a plurality of game or other suitable images, symbols or indicia.

As illustrated in FIG. 2A, gaming device 10 includes at least one payment acceptor 24 in communication with the processor. As seen in FIGS. 1A and 1B, payment acceptor 24 may include a coin slot 26 and a payment, note or bill acceptor 28, in which the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of gaming device 10. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to gaming device 10. In one embodiment, money may be transferred to a gaming device through electronic funds transfer. When a player funds the gaming device, processor 12 determines the amount of funds entered and displays the corresponding amount on the credit or other suitable display as described above.

As seen in FIGS. 1A, 1B and 2A, in one embodiment gaming device includes 10 at least one and likely a plurality of input devices 30 in communication with the processor. Input devices 30 can include any suitable device then enables the player to produce an input signal which is received by the processor. In one embodiment, after appropriate funding of gaming device 10, the input device is a game activation device, such as a pull arm 32 or a play button 34, which is used by the player to start any primary game or sequence of events in gaming device 10. Play button 34, can be any suitable play activator such as a bet one button, a max bet button or a repeat the bet button. Upon appropriate funding, gaming device 10 can begin game play automatically. Alternatively, the player engages one of the play buttons, activate game play.

As shown in FIGS. 1A and 1B, one input device is a bet one button 36. The player places a bet by pushing bet one button 36. The player can increase the bet by one credit each time the player pushes bet one button 36. When the player pushes bet one button 36, the number of credits shown in the credit display 20 decreases by one, and the number of credits shown in the bet display increases by one. Another input device is a bet max button (not shown), which enables the player to bet the maximum wager permitted for a game of the gaming device.

A fourth input device is a cashout button 38. The player pushes cashout button 30 to cashout to receive a cash payment or other suitable form of payment corresponding to the number of remaining credits. When the player cashes out, the player can receive coins or tokens in a coin payout tray 40. Alternatively, upon a cashout the player receives a payout in another form such as tickets or credit slips redeemable by a cashier (or other suitable redemption system) or funding to the player's electronically recordable identification card.

As mentioned above and seen in FIG. 2A inputs into gaming device 10 may be made via a touch screen 42 coupled with a touch screen controller 44, or some other touch-sensitive display overlay to allow for player interaction with the images on display device 16 or 18. Touch screen 42 and the touch screen controller 44 are connected to a video controller 46. A player can make decisions and input signals into the gaming device by touching the touch screen 42 at the appropriate places. One such input device is a touch screen overlay. It should be appreciated that the utilization of touch screens is widespread in the gaming industry.

Gaming device 10 may further include a plurality of communication ports for enabling communication of processor 12 with external peripherals, such as external video sources, expansion buses, game or other displays, an SCSI port or a key pad.

In one embodiment, as seen in FIG. 2A, gaming device 10 includes a sound generating device controlled by one or more sounds cards 48 which function in conjunction with the processor. The sound generating device includes at least one and likely a plurality of speakers 50 or other sound generating hardware and/or software for generating sounds, such as playing music for the primary and/or secondary game or for other modes of the gaming device, such as an attract mode. Gaming device 10 can provide dynamic sounds coupled with attractive multimedia images displayed on one or more of the display devices to provide an audio-visual representation or to otherwise display full-motion video with sound to attract players to the gaming device. During idle periods, gaming device 10 may display a sequence of audio and/or visual attraction messages to attract potential players to the gaming device. The videos may also be customized for or to provide any appropriate information.

In one embodiment, gaming machine 10 may include a sensor, such as a camera in communication with processor 12 (and possibly controlled by the processor) that is selectively positioned to acquire an image of a player actively using gaming device 10 and/or the surrounding area of gaming device 10. The camera may be configured to selectively acquire still or moving (e.g., video) images and may be configured to acquire the images in either an analog, digital or other suitable format. Display devices 16 and 18 may be configured to display the image acquired by the camera as well as display the visible manifestation of the game in split screen or picture-in-picture fashion. For example, the camera may acquire an image of the player and processor 12 may incorporate that image into the primary and/or secondary game as a game image, symbol or indicia.

Gaming device 10 can incorporate any suitable wagering primary or base game. Gaming machine or device 10 may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

Slot Game

As illustrated in FIGS. 1A and 1B, a base or primary game may be a slot game with one or more payline 52. Paylines 52 may be horizontal, vertical, circular, diagonal, angled or any combination thereof. Here, gaming device 10 includes at least one and preferably a plurality of reels 54, such as three to five reels 54, in either electromechanical form with mechanical rotating reels or video form with simulated reels and movement thereof. In one embodiment, an electromechanical slot machine 10 includes a plurality of adjacent, rotatable reels which may be combined and operably coupled with an electronic display of any suitable type. In another embodiment, if the reels 54 are in video form, one or more of the display devices 16 or 18, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, gaming device 10 awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, gaming device 10 determines any outcome to provide to the player based on the number of associated symbols, which are generated in active symbol positions on the requisite number of adjacent reels 54 (i.e., not on paylines passing through any displayed winning symbol combinations). Here, if a winning symbol combination is generated on the reels 54, gaming device 10 provides the player one award for that occurrence of the generated winning symbol combination. For example, if one winning symbol combination is generated on the reels 54, gaming device 10 provides a single award to the player for that winning symbol combination (i.e., not based on the number of paylines 52 that would have passed through that winning symbol combination). It should be appreciated that because a gaming device 10 with wagering on ways to win provides the player one award for a single occurrence of a winning symbol combination and a gaming device 10 with paylines 52 may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device 10 with paylines 52.

In one embodiment, the total number of ways to win is determined by multiplying the number of symbols generated in active symbol positions on a first reel 54 by the number of symbols generated in active symbol positions on a second reel by the number of symbols generated in active symbol positions on a third reel 54 and so on for each reel 54 of gaming device 10 with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device 10 with three symbols generated in active symbol positions on each reel includes 81 ways to win (i.e., 3 symbols on the first reel×3 symbols on the second reel×3 symbols on the third reel×3 symbols on the fourth reel). A five reel gaming device 10 with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels 52 or modifying the number of symbols 52 generated in active symbol positions by one or more of the reels, modifies the number of ways to win.

In another embodiment, gaming device 10 enables a player to wager on and thus activate symbol positions. In one such embodiment, the symbol positions are on the reels 52. In here, if based on the player's wager, a reel is activated, then each of the symbol positions of that reel 52 will be activated and each of the active symbol positions will be part of one or more of the ways to win. If based on the player's wager, a reel 52 is not activated, then a designated number of default symbol positions, such as a single symbol position of the middle row of the reel 52, can be activated and the default symbol position(s) will be part of one or more of the ways to win. This type of gaming machine 10 enables a player to wager on one, more or each of the reels 54 and processor 12 of gaming device 10 uses the number of wagered on reels 52 to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

When a player wagers on one or more reels 52, a player's wager of one credit may activate each of the three symbol positions on a first reel, wherein one default symbol position is activated on each of the remaining four reels 54. In this example, as described above, gaming device 10 provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel 54, each of the three symbol positions on a second reel 54 and each of the three symbol positions on a third reel 54 wherein one default symbol position is activated on each of the remaining two reels 54. In this example, as described above, gaming device 10 provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, gaming device 10 individually determines if a symbol generated in an active symbol position on a first reel 54 forms part of a winning symbol combination with or is otherwise suitably related to a symbol generated in an active symbol position on a second reel 54. In this embodiment, gaming 10 device classifies each pair of symbols which form part of a winning symbol combination (i.e., each pair of related symbols) as a string of related symbols. For example, if active symbol positions include a first cherry symbol generated in the top row of a first reel 54 and a second cherry symbol generated in the bottom row of a second reel 54, gaming device 10 classifies the two cherry symbols as a string of related symbols because the two cherry symbols form part of a winning symbol combination.

After determining if any strings of related symbols are formed between the symbols on the first reel 54 and the symbols on the second reel 54, gaming device 10 determines if any of the symbols from the next adjacent reel should be added to any of the formed strings of related symbols. In this embodiment, for a first of the classified strings of related symbols, gaming device 10 determines if any of the symbols generated by the next adjacent reel form part of a winning symbol combination or are otherwise related to the symbols of the first string of related symbols. If gaming device 10 determines that a symbol generated on the next adjacent reel 54 is related to the symbols of the first string of related symbols, that symbol is subsequently added to the first string of related symbols. For example, if the first string of related symbols is the string of related cherry symbols and a related cherry symbol is generated in the middle row of the third reel 54, gaming device 10 adds the related cherry symbol generated on the third reel 54 to the previously classified string of cherry symbols.

On the other hand, if gaming device 10 determines that no symbols generated on the next adjacent reel 54 are related to the symbols of the first string of related symbols, the gaming device marks or flags such string of related symbols as complete. For example, if the first string of related symbols is the string of related cherry symbols and none of the symbols of the third reel is related to the cherry symbols of the previously classified string of cherry symbols, gaming device 10 marks or flags the string of cherry symbols as complete.

After either adding a related symbol to the first string of related symbols or marking the first string of related symbols as complete, gaming device 10 proceeds as described above for each of the remaining classified strings of related symbols which were previously classified or formed from related symbols on the first and second reels 54.

After analyzing each of the remaining strings of related symbols, gaming device 10 determines, for each remaining pending or incomplete string of related symbols, if any of the symbols from the next adjacent reel 54, if any, should be added to any of the previously classified strings of related symbols. This process continues until either each string of related symbols is complete or there are no more adjacent reels 54 of symbols to analyze. Here, where there are no more adjacent reels of symbols to analyze, gaming device 10 marks each of the remaining pending strings of related symbols as complete.

When each of the strings of related symbols is marked complete, gaming device 10 compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

The base or primary game may be a poker game, in which gaming device 10 enables the player to play a conventional game of video draw poker and initially deals five cards all face up from a virtual deck of fifty-two card deck. Cards may be dealt as in a traditional game of cards or in the case of gaming device 10, may also include that the cards are randomly selected from a predetermined number of cards. If the player wishes to draw, the player selects the cards to hold via one or more input device, such as pressing related hold buttons or via touch screen 42. The player then presses the deal button and the unwanted or discarded cards are removed from the display and gaming machine 10 deals the replacement cards from the remaining cards in the deck. This results in a final five-card hand. Gaming device 10 compares the final five-card hand to a payout table which utilizes conventional poker hand rankings to determine the winning hands. Gaming device 10 provides the player with an award based on a winning hand and the credits the player wagered.

In another embodiment, the base or primary game may be a multi-hand version of video poker. In this embodiment, gaming device 10 deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game in which gaming device 10 displays a plurality of selectable indicia or numbers on at least one of the display devices. In this embodiment, the player selects at least one or a plurality of the selectable indicia or numbers via an input device such as the touch screen 42. The gaming device 10 then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In addition to winning credits or other awards in a base or primary game, gaming device 10 may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline 52 in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 provides the player one or more plays of one or more secondary games randomly. In one such embodiment, gaming device 10 does not provide any apparent reasons to the player for qualifying to play a secondary or bonus game. In this embodiment, qualifying for a bonus game is not triggered by an event in or based specifically on any of the plays of any primary game. That is, gaming device 10 may simply qualify a player to play a secondary game without any explanation or alternatively with simple explanations. In another embodiment, gaming device 10 (or central server) qualifies a player for a secondary game at least partially based on a game triggered or symbol triggered event, such as at least partially based on the play of a primary game.

In one embodiment, gaming device 10 includes a program which begin a bonus round automatically after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player make separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
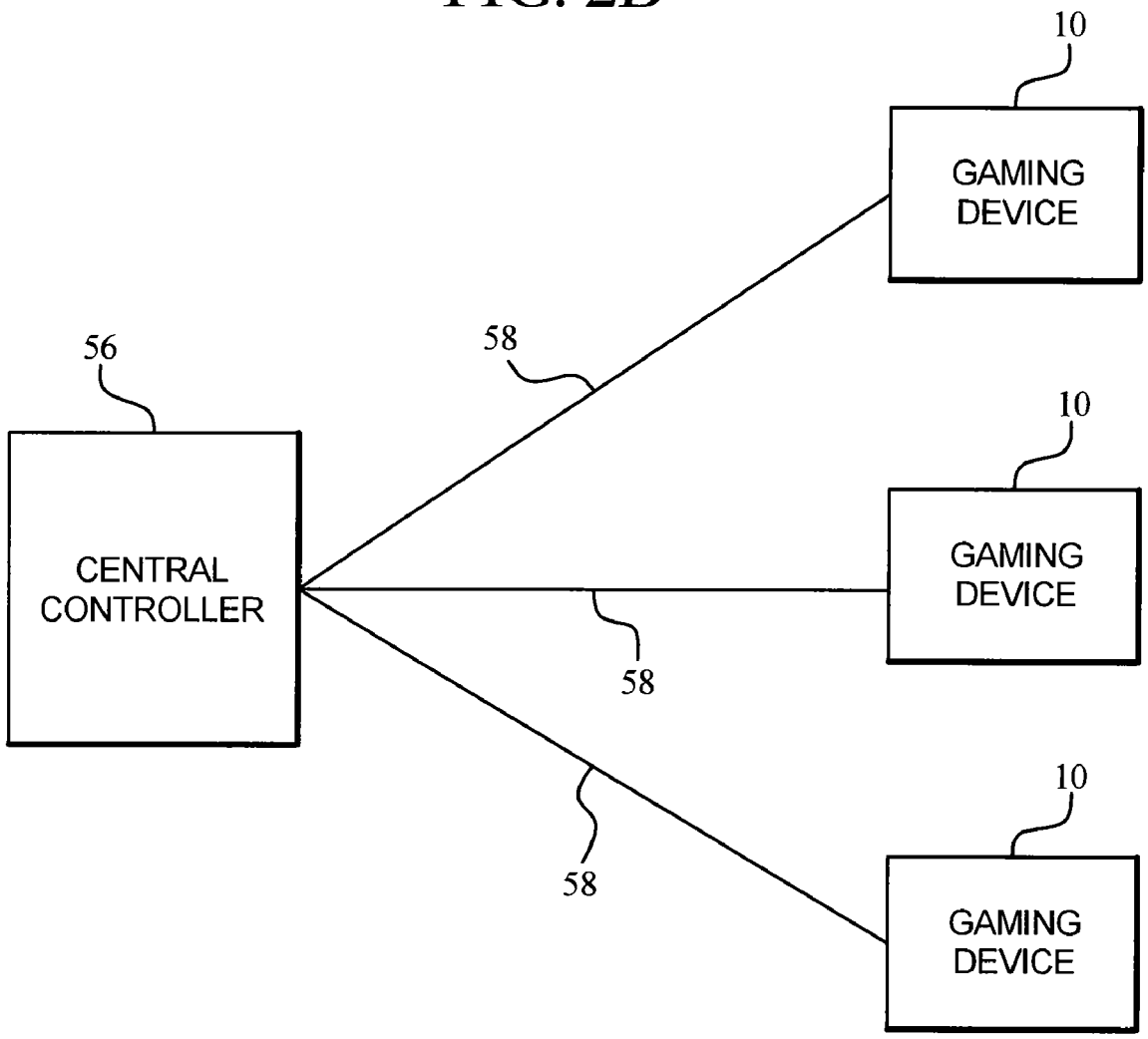
FIG. 2B is a schematic block diagram of one embodiment of a network configuration for a plurality of gaming devices of the present disclosure.

As illustrated in FIG. 2B, one or more of gaming devices 10 can communicate with each other and/or at least one central server, central controller or remote host 56 through a data network or remote communication link 58. Here, central server, central controller or remote host 56 is any suitable server or computing device this includes at least one processor and at least one memory or storage device. In different such embodiments, the central server 56 is a progressive controller or a processor of one of the gaming devices in the gaming system. Here, processor 12 of each gaming device is designed to transmit and receive events, messages, commands or any other suitable data or signals between the individual gaming device and the central server. Gaming device processor 12 is operable to execute such communicated events, messages or commands in conjunction with the operation of gaming device 10. Moreover, the processor of the central server 56 is designed to transmit and receive events, messages, commands or any other suitable data or signal between the central server and each of individual gaming devices 10. The central server processor is operable to execute such communicated events, messages or commands in conjunction with the operation of the central server. It should be appreciated that one, more than one or each of the functions of the central controller 56 as disclosed herein may be performed by one or more gaming device processor 42. It should be further appreciated that one, more or each of the functions of one or more gaming device processor 42 as disclosed herein may be performed by the central controller 56.

In one embodiment, the game outcome provided to the player is determined by central server or controller 56 and provided to the player at gaming device 10. In this embodiment, each of a plurality of such gaming devices communicate with central server or controller 56. Upon a player initiating game play at one of gaming devices 10, the initiated gaming device 10 communicates a game outcome request to the central server or controller 56.

In one embodiment, the central server or controller 56 receives the game outcome request and randomly generates a game outcome for the primary game based on probability data. In another embodiment, the central server or controller 56 randomly generates a game outcome for the secondary game based on probability data. In a further embodiment, central server or controller 56 generates a game outcome randomly for both the primary game and the secondary game based on probability data. In this embodiment, the central server or controller 56 is capable of storing and utilizing program code or other data similar to processor 12 and memory device 14 of gaming device 10.

In an alternative embodiment, central server or controller 56 maintains one or more predetermined pools or sets of predetermined game outcomes. In this embodiment, the central server or controller 56 receives the game outcome request and independently selects a predetermined game outcome from a set or pool of game outcomes. The central server or controller 56 flags or marks the selected game outcome as used. Once a game outcome is flagged as used, it is prevented from further selection from the set or pool and cannot be selected by the central controller or server 56 upon another wager. The provided game outcome can include a primary game outcome, a secondary game outcome, primary and secondary game outcomes, or a series of game outcomes such as free games.

The central server or controller 56 communicates the generated or selected game outcome to the initiated gaming device. Gaming device 10 receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller 56 and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device 10 utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device 10 is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device 10 as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices 10 based, at least in part, on the selected elements on the provided bingo cards. As described above, the game outcome determined for each gaming device 10 enrolled in the bingo game is utilized by that gaming device 10 to determine the predetermined game outcome provided to the player. For example, a first gaming device to have selected elements marked in a predetermined pattern is provided a first outcome of win $10, which will be provided to a first player regardless of how the first player plays in a first game and a second gaming device 10 to have selected elements marked in a different predetermined pattern is provided a second outcome of win $2, which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device 10 will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device 10 may be provided a supplemental or intermittent award regardless of if the enrolled gaming device's provided bingo card wins or does not win the bingo game as described above.

In another embodiment, one or more of the gaming devices are in communication with a central server or controller 56 for monitoring purposes only. That is, each individual gaming device 10 generates the game outcomes randomly to be provided to the player and the central server or controller 56 monitors the activities and events occurring on the plurality of gaming devices 10. In one embodiment, the gaming network includes a real-time or on-line accounting and gaming information system operably coupled to the central server or controller 56. The accounting and gaming information system of this embodiment includes a player database for storing player profiles, a player tracking module for tracking players and a credit system for providing automated casino transactions.

In one embodiment, gaming device 10 is associated with or otherwise integrated with one or more player tracking systems. In here, gaming device 10 and/or player tracking system tracks any players gaming activity at the gaming device. In one such embodiment, the gaming device 10 and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, gaming device 10 utilizes one or more portable devices carried by a player, such as a cell phone, a radio frequency identification tag or any other suitable wireless device to track when a player begins and ends a gaming session. In another embodiment, gaming device 10 utilizes any suitable biometric technology or ticket technology to track when a player begins and ends a gaming session.

During one or more gaming sessions, gaming device 10 and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In one embodiment, a plurality of gaming devices 10 are capable of being connected together through a data network. In one embodiment, the data network is a local area network ("LAN"), in which one or more of the gaming devices are substantially proximate to each other and an on-site central server or controller as in, for example, a gaming establishment or a portion of a gaming establishment. In another embodiment, the data network is a wide area network ("WAN") in which one or more of the gaming devices is in communication with at least one off-site central server or controller 56. In this embodiment, the plurality of gaming devices 10 may be located in a different part of the gaming establishment or within a different gaming establishment than the off-site central server or controller 56. Thus, the WAN may include an off-site central server or controller and an off-site gaming device 10 located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at gaming device 10 with at least one internet browser. In this embodiment, operation of the gaming device and accumulation of credits may be accomplished with only a connection to the central server or controller 56 (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices 10 is in communication with a central server or controller. Central server or controller 56 may be any suitable server or computing device which includes at least one processor and a memory or storage device. In alternative embodiments, the central server 56 is a progressive controller or another gaming machine in the gaming system. The memory device of central server 56 can store different game programs and instructions, which are executable by gaming device processor 12, to control gaming device 10. Each executable game program represents a different game or type of game which may be played on one or more of gaming devices 10 in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device 10 at least includes one or more display devices and/or one or more input devices for interaction with a player. A local processor, such as the above-described gaming device processor 12 or a processor of a local server, is operable with the display device(s) and/or the input device(s) of one or more of the gaming devices.

In operation, central server 56 is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from central server 56, the local processor 12 executes the communicated program to facilitate play of the communicated program by a player through the display device(s) and/or input device(s) of the gaming device. That is, when a game program is communicated to a local processor, local processor 12 changes the game or type of game played at the gaming device.

In another embodiment, a plurality of gaming devices 10 at one or more gaming sites may be networked to the central server 56 in a progressive configuration, as known in the art, wherein a portion of each wager to initiate a base or primary game is allocated to one or more progressive award. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer 56 oversees the entire progressive gaming system and is the master for computing all progressive jackpots. All participating gaming sites report to, and receive information from, the progressive gaming system host site computer 56. Each central server computer is responsible for all data communication between the gaming device hardware and software and the progressive gaming system host site computer 56. In one embodiment, an individual gaming machine may trigger a progressive award win. In another embodiment, a central server 56 (or the progressive gaming system host site computer) determines when a progressive award win is triggered. In another embodiment, an individual gaming machine and a central controller 56 (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, gaming device 10 is randomly or apparently randomly selected to provide a player of gaming device one or more progressive award. In one such embodiment, gaming device 10 does not provide any apparent reasons to the player for winning a progressive award, and winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards is funded partially via a side-bet or side-wager, which the player may make (and which may be tracked via a side-bet meter). In one embodiment, one or more of the progressive awards is funded with only side-bets or side-wagers placed. In another embodiment, one or more of the progressive awards are funded based on player's wagers as described above as well as any side-bets or side-wagers placed.

In one alternative embodiment, a minimum wager level is required for gaming device 10 to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices 10 in a gaming system participate in a group gaming environment. In one embodiment, a plurality of players at a plurality of linked gaming devices 10 work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices 10 compete against one another for one or more award. In one such embodiment, a plurality of players at a plurality of linked gaming devices 10 participate in a gaming tournament for one or more awards. In another embodiment, a plurality of players at a plurality of linked gaming devices 10 play for one or more awards wherein an outcome generated by one gaming device 10 affects the outcomes generated by one or more linked gaming devices 10.

Award Distribution Using Shares

Figure 3:
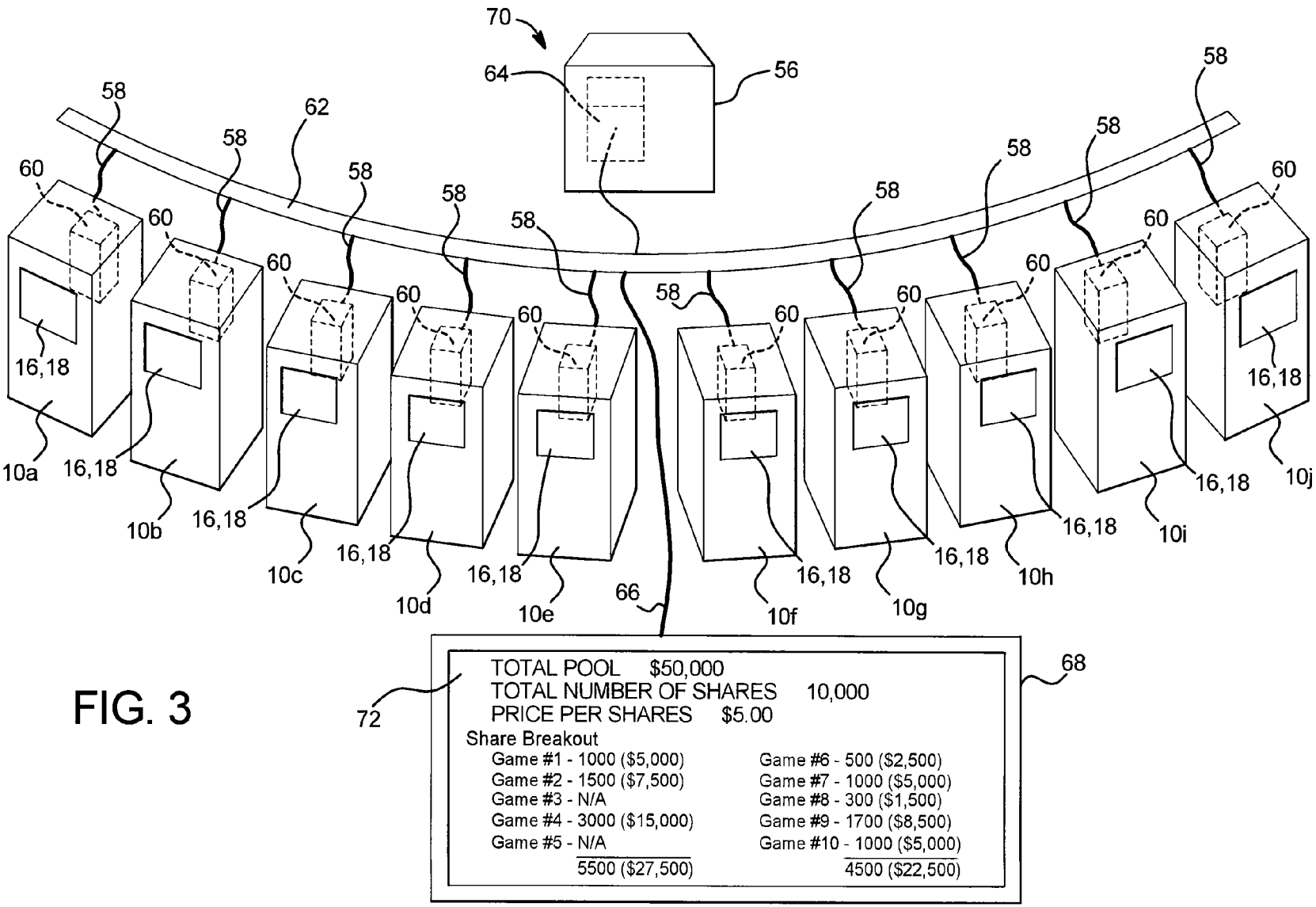
FIG. 3 is an elevation view of one embodiment of a gaming device system having award distribution using shares according to the present disclosure.

Referring now to FIG. 3, one gaming system employing an awarded distribution scheme using shares is illustrated by gaming system 70. In the illustrated embodiment, ten gaming devices, namely gaming devices 10*a* to 10*j*, play against one another for portions of a designated award or bonus pool. While ten gaming devices are illustrated, it should be appreciated that gaming system 70 can link any suitable number of gaming devices, which can be linked locally, across an entire casino, across multiple casinos, across an internet, a state, a country, and multi-nationally and be carried out over a LAN, WAN, internet or any combination thereof.

One or more video monitors 16 or 18 are illustrated for each gaming device 10*a* to 10*j*. Each gaming device also includes a control unit 60. Control unit 60 houses one or more processors 12, one or more memory devices 14, video controller 46, touch screen controller 44 (all shown above in connection with FIG. 2A), and any other equipment necessary for each gaming device 10*a* through 10*j* to communicate via data link 58 and data bus or network 62 with server computer 56.

Server computer 56 likewise includes a control unit 64 having one or more processors and/or memory devices, which communicates via network or data bus 62 and each of the links 58 to gaming devices 10*a* to 10*j*. Links 58 and network or data bus 62 can be of any of the variety of types discussed above in connection with FIGS. 2A and 2B. Moreover, the processing and memory capability of control unit 64 or server computer 56 can be of any of the types and varieties discussed above in connection with the processing and memory capabilities of gaming device 10. Control unit 64 also includes a video RAM or video controller that communicates via link 66 to large overhead display 68. It should be appreciated that in alternative embodiments, any of the data linkages 58, 62 and 66 can be replaced with radio frequency, microwave or other alternative wireless technology.

In one embodiment, individual video monitors 16 and 18 of gaming devices 10*a* to 10*j* show the same or substantially the same indicia that large overhead display 68 shows. In another embodiment, individual video monitors 16 and 18 of gaming devices 10*a* to 10*j* show different or substantially different indicia than the indicia that large overhead display 68 shows. Additionally, video monitors 16 and 18 show base game, paytable, and game instruction information as described above. That is, the bonus pool and the maintenance and transfer of shares is performed in addition to any of the primary base games discussed herein. Here, players play the base wagering game via video monitor 16 or 18. Large overhead display 68 shows the share information until the bonus is hit by one of the gaming devices 10*a* to 10*j*, after which large overhead display 68 shows a bonus sequence, such as a distribution sequence downloading funds via the shares to actively played gaming devices 10. It should be appreciated that one or more large overhead displays which each illustrate information regarding the gaming system disclosed herein may be situated at various locations throughout a gaming establishment.

In the illustrated embodiment, the large overhead display 68 includes a large video screen 72, which can be any type of video screen described above for monitors 16 and 18. Video screen 72 shows that a total pool or designated award of $50,000 is available to be distributed between each of the actively played gaming devices 10*a* to 10*j* per each actively played gaming device's current number of shares. The large overhead display 68 also shows that 10,000 shares are currently outstanding. This leads to the display of a price per share of $5 or, for example, five credits in the case in which a credit is worth $1.

The overhead display 68 also shows the share breakout or distribution for each actively played gaming device and shows which gaming device(s) of gaming system 70 is currently not actively played. In the illustrated example, Game #1 or gaming device 10*a* has one-thousand of the ten-thousand outstanding shares, which would translate into an award of $5,000. Game #2 or gaming device 10*b* has fifteen-hundred of the ten-thousand outstanding shares for a potential award value of $7,500, and so on. Games #3 and #5 or gaming devices 10*c* and 10*e* are currently not actively played.

In one embodiment, gaming devices 10*a* to 10*j* enable players to play base wagering games (such as any of the base wagering games discussed above) and the total pool shown on large overhead display 68 is funded, at least in part, using a portion of each wager placed on the corresponding base games each time such a wager is made at one of the constituent gaming devices. In different embodiments, the portion of each wager placed on a corresponding base game which funds the bonus event pool is predetermined, randomly determined, determined based on the player's status (such as determined through a player tracking system), determined based on time, determined based on a random determination by the central controller, determined based on a random determination at the gaming machine, determined based on one or more side wagers placed or determined based on any other suitable method or criteria.

In one embodiment, a plurality of or each of the gaming devices 10*a* to 10*j* play the same base game. Alternatively, a plurality of or each of the gaming devices play different base games. In one such embodiment, even if a plurality of gaming devices each play different base games, each gaming device contributes the same proportion of the base game wager to the total bonus pool regardless of which type of base game is played, so that each gaming device contributes the same percentage amount to the total bonus pool. In one such embodiment, regardless of the type of base game played, the likelihood of gaining shares discussed in more detail below is the same for each constituent gaming device 10*a* to 10*j*. In this manner, no player benefits or is prejudiced by playing any type of game with regard to the ability to generate shares.

In one embodiment, each share is provided for each monetary unit wagered. For example, a player that wagers a first amount of monetary units gets a first number shares and a player that wagers a second greater amount of monetary units gets a second, greater number of shares upon an occurrence of a share providing event. In another embodiment, the number of shares provided to a player upon an occurrence of a share providing event corresponds to the amount or value which the player contributed to the total bonus pool. In this embodiment, because one or more shares are nullified or retired as different players stop playing, the number of shares provided to a player upon the occurrence of the share providing event may be greater than the amount contributed to the total bonus pool. It should be appreciated that a gaming system operator is enabled to set the gaming system to provide shares at any suitable rate during any suitable time period.

In another embodiment, the total bonus pool or designated award is funded, at least in part, by the primary game paytable associated with one or more of the gaming devices in the gaming system. In another embodiment, the total bonus pool or designated award is funded, at least in part, by one or more side bets or side wagers placed. In another embodiment, the total bonus pool or designated award is funded, at least in part, by a gaming establishment, such as a casino's marketing department. In another embodiment, the total bonus pool or designated award increments each time an incrementing factor occurs wherein examples of incrementing factors could be a symbol-driven trigger in the base game, the occurrence of one or more events in a bonus game, the player betting a maximum amount, a percentage of possible gaming machines being actively played or in active status, or any other suitable method for defining an incrementor.

Figure 4:
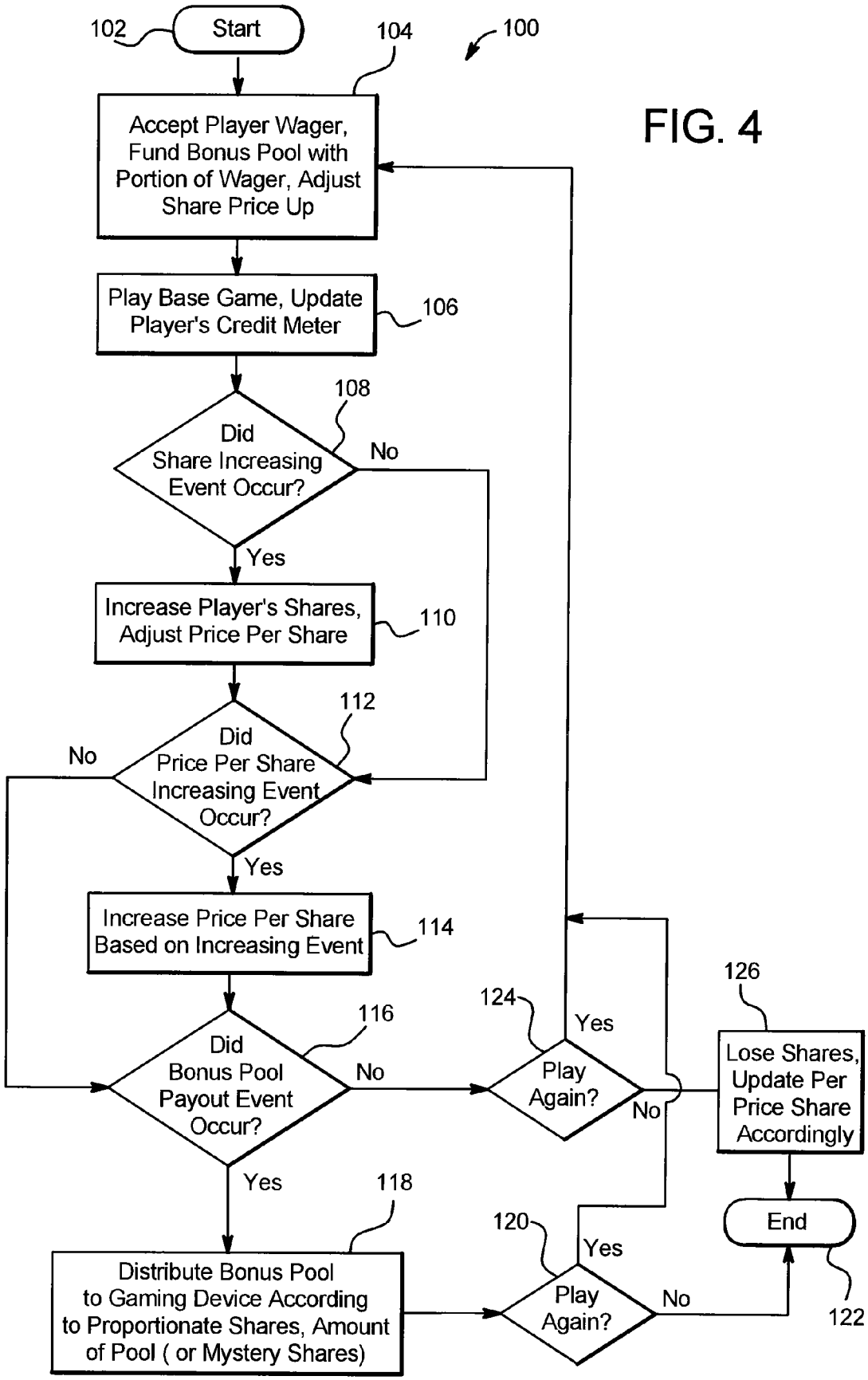
FIG. 4 is a schematic block diagram of one sequence of operation for a gaming system having award distribution using shares according to the present disclosure.

Referring now to FIG. 4, one sequence of operation for gaming system 70 is illustrated by sequence 100. Sequence 100 shows how a single gaming device within gaming system 70 is operated. That is, sequence 100 is performed at the individual gaming device level. Upon starting the sequence, as indicated by oval 102, gaming device 10 accepts the player's wager and funds the bonus pool with a portion of the wager, as indicated by block 104. In one embodiment, as described above, the funding is a percentage of the player's wager. The game of slot, for example, enables the player's wager to vary by enabling the player to select a number of paylines to play and a number of coins to play per payline. In the example shown below in connection with FIG. 8, the three payline game enables the player to wager up to five coins per line. Thus, in this example, the player can wager anywhere between one coin on one line or five coins on all three lines, totaling fifteen coins. The player wagering more coins contributes more per that play to the bonus pool. As discussed in more detail below, the player wagering more is compensated for contributing more to the bonus pool by having the potential to generate more shares of the bonus pool. In one embodiment, the expected value of the bonus pool for each player is independent of how much the player wagers. In an alternative embodiment, the gaming system is structured such that the player becomes eligible to win more shares upon wagering a certain threshold, such as maximum wager. In another embodiment, the gaming system is structured such that the amount of shares a player becomes eligible for is based, at least in part, on the player's status (as determined through a player tracking system).

As also indicated in block 104 of FIG. 4, the contribution from the player's wager adjusts the price of each outstanding share up a certain amount. Given the multitude of constituent gaming devices 10 and the need for flexibility, in one embodiment share price is divided into multiple decimal places of a credit. For example, if a credit is worth $1, shares may be paid out rounding to the nearest cent. Accordingly, gaming system 70 in one embodiment pays out using a ticketing system, such as the EZpay® ticket system provided by the assignee of the present application. EZpay is a registered trademark of IGT, the assignee of the present application. This allows a ticket to be generated upon a player cashout, which can have payouts specific to hundredths of a credit. Credit meter 20 can likewise read out in terms of hundredths of a credit in gaming system 70 employing sequence 100. Alternatively, credit meter 20 reads out in thousandths of a credit, wherein a payout is rounded to the nearest hundredth of a credit, such as to the nearest penny when a credit is worth $1.

As seen in connection with block 106, the player plays the base game and the player's credit meter is updated accordingly. Sequence 100 determines whether a share increasing event has occurred in the outcome of the base game, as determined in connection with diamond 108. If a share increasing event has occurred, the player's shares are increased accordingly, as seen in connection with block 110. Share increases can be triggered by a base game outcome (e.g., certain designated symbols or symbol combinations occurring in a play of a game), bonus game outcome, threshold amount wagered, losing game outcome, winning game outcome, amount of time played, number of games played, a random determination by the central controller, a random determination at the gaming machine, an event associated with a player tracking system, amount wagered per game, total amounts waged during designated time periods, a side wager placed, a comparison of a player's winning outcomes to losing outcomes, a denomination played, a game type played, a player's non-game play history, a player's table game activity, an event selected by a gaming establishment operator, and any combination thereof. Due to the increase in shares, the share price (as adjusted in connection with block 104) is diluted slightly.

The player still has an overall larger portion of the total pool however due to the share increase. Again, fractions of a credit are useful here.

Gaming system 70 employing sequence 100 determines whether a price per share increasing event has occurred, as seen in connection with diamond 112. Although optional, it is also contemplated that a certain combination of symbols resulting in the base game for example can result in a bonus pool increase, which raises the price per share for each actively played gaming device. For example, an event could occur, which causes each gaming machine's price per share to be upgraded to the nearest whole credit or adds a specified number of credits to the price of each outstanding share. Besides a game outcome, any other triggering event listed above in connection with the share increasing triggers in connection with diamond 108 can also trigger a price per share increase.

If a price per share increasing event does occur, as determined in connection with diamond 112, gaming system 70 employing sequence 100 increases the price per share based on the increasing event, as seen in connection with block 114. The price increase starts from the adjusted share price made in connection with block 104 or the adjusted share price made in connection with block 110. Again, it may be helpful to display credits and/or share price in fractions or tenths, hundredths or thousandths of credits.

Whether or not a price per share increasing event occurs as determined in connection with diamond 112, gaming system 70 employing sequence 100 determines whether a bonus pool payout event has occurred in the base game, as seen in connection with diamond 116. Bonus pool payouts can be triggered via: (i) an amount of time played collectively on the actively played gaming devices; (ii) a random time of the day; (iii) an amount of money wagered collectively on the actively played gaming devices; (iv) an amount of money lost collectively by the actively played gaming devices; (v) an amount of money won collectively by the actively played gaming devices; (vi) upon an event occurring in the base game of one of the actively played gaming devices; and/or (viii) upon an event occurring due to a shared random outcome generation. That is, in one embodiment, the triggering of the bonus pool or designated award payout occurs through a game play event, such as the generation of a designated symbol or symbol combination or any other suitable symbol-driven trigger, at an individual gaming machine in the gaming system. In another embodiment, the triggering of the bonus pool or designated award payout occurs independent of any game play event which may occur in any primary game or any secondary game played at one or more gaming machines in the gaming system.

In one such embodiment, the triggering of the bonus pool or designated award payout occurs based on at least one accumulated value pools incrementing to a hit value. In this embodiment, the gaming system includes one or more accumulated value pools or $N^{th}$ coin pools. Such accumulated value pools are driven by an amount of wagers placed or a suitable coin-in amount. In one such embodiment, each accumulated value pool is associated with a range of values, wherein the bonus pool or designated award payout occurs when the accumulated value pool increments to a hit value within the range of values associated with that pool. That is, when an accumulated value pool increases to a determined hit value, a triggering of the bonus pool payout will occur. In different embodiments, the hit value at which an accumulated value pool causes a triggering of the bonus pool or designated award payout to occur is predetermined, randomly determined, determined based on the wagers placed in the gaming system, determined based on the status of one or more players (such as determined through a player tracking system), determined based on time, or determined based on any other suitable method. In this embodiment, after the accumulated value pool causes the triggering of the bonus pool or designated award payout to occur, the accumulated value pool is reset to a default value and starts incrementing from the default value.

In another such embodiment, the triggering of the bonus pool or designated award payout is based on time. In this embodiment, a time is set for when a triggering of the bonus pool or designated award payout will occur. In one embodiment, such a set time is based on historic data. For example, if previous bonus pool payouts triggers have occurred after approximately sixty-seven hours, a bonus pool payout may be set to trigger sixty-seven hours from the conclusion of the previous bonus pool payout.

In another such embodiment, the triggering of the bonus pool or designated award payout is based on a predefined variable reaching a defined parameter threshold. For example, the bonus pool payout is triggered when the $500^{th}$ different player has played a gaming machine associated with the bonus pool (ascertained from a player tracking system). In different embodiments, the predefined parameter thresholds include a length of time, a length of time after a certain dollar amount is hit, a wager level threshold for a specific machine (which gaming device is the first to contribute $250,000), a number of gaming machines active, or any other parameter that would define a threshold for the bonus pool payout.

In another such embodiment, the triggering of the bonus pool or designated award payout occurs after a random number of plays in which the bonus pool payout is not triggered. In another embodiment, the triggering of the bonus pool or designated award payout occurs based upon a gaming system operator defined player eligibility parameters stored on a player tracking system (such as via a player tracking card or other suitable manner).

In another such embodiment, the triggering of the bonus pool or designated award payout includes a system determination which is based on a random selection by the central controller. In this embodiment, the central controller tracks all actively played gaming machines and the wagers they placed (via an accumulated wager pool). When the accumulated wager pool at least exceeds a predefined threshold, the central controller randomly determines (at predetermined intervals) if a bonus pool payout will occur.

In another such embodiment, the central controller determines, in cooperation with the gaming device, when to trigger a bonus pool payout by utilizing one or more random number generators. In this embodiment, the central controller determines when to trigger a bonus pool payout by determining if any numbers allotted to a gaming device match a randomly selected number. In one such embodiment, upon or prior to each play of each gaming machine, a random number is selected from a range of numbers and during each primary game, the gaming machine allocates the first N numbers in the range, where N is the number of credits bet by the player in that primary game. At the end of the primary game, the randomly selected number is compared with the numbers allocated to the player and if a match occurs, that particular gaming machine triggers a bonus pool payout. It should be appreciated that any suitable manner of triggering the bonus pool payout may be implemented with the gaming system disclosed herein.

In one embodiment, if any of the gaming devices 10*a* to 10*j* triggers the bonus pool payout, each of the actively played gaming devices receives its portion of the bonus pool, wherein the portion is determined by the number of shares for the gaming device as well as the current price per share. Accordingly, if a bonus payout trigger has occurred, gaming system 70 according to sequence 100 distributes the bonus pool to the gaming devices according to each game's proportionate shares, amount of the pool and in certain instances according to mystery shares, as seen in connection with block 118. In one such embodiment, the gaming device associated with triggering the bonus event through play of that gaming device's base game is provided one or more mystery shares.

In one embodiment, the gaming system determines if a player is actively playing a gaming device to provide one or more shares to based on the gaming device's status as active or inactive. In this embodiment, inactive status means that the gaming machine is one of the linked gaming machines in the gaming system, but is not being actively played by a player during the designated qualification period. A gaming machine may be classified as inactive status for several reasons. For example, no player may be playing the gaming machine. In another example, a player could be playing the gaming machine (i.e., by having credits on the gaming machine), but be playing too slowly or be interrupted during play. In this case, the player could have credits on the credit meter of the gaming machine, but the player has not made a wager on a primary game or otherwise qualified for a share distribution event during the designated qualification period.

In this embodiment, active status means that the gaming machine is being actively played by a player during a designated qualification period. In one embodiment, actively playing during a designated qualification period means that the player is playing the primary game of the gaming machine (i.e., placing wagers on plays of the primary game) at least at a predefined minimum rate during a predefined time period. For example, the gaming machine may be in active status when a player has made at least one play of the primary game in a fifteen second period prior to the triggering of a share distribution event. In this example, the designated qualification period is that fifteen second period prior to the triggering of the share distribution event.

In another embodiment, the active status is alternatively or additionally based on the amount wagered on the plays of the primary game during a designated qualification period. In a further alternative embodiment, the determination of the active status is based on a designated minimum number of plays of the primary game or number of wagers on the primary game in a designated time period. The determination of active status may take into account other factors such as interruptions or displays in play of the primary game such as caused by the triggering of other bonuses or the operation of other secondary games of the gaming machines. In another embodiment, a gaming machine can only be determined to be an active gaming machine if an additional wager, such as a side-bet or side-wager, is made by a player at a gaming machine of the gaming system for one player of a game, a plurality of plays of a game or all plays of a game in a designed period of time, such as a designed time period. In another embodiment, the determination of whether to classify a gaming device as in active status is based on a combination wagers placed and time. In one such embodiment, the greater the wager amount placed by a player at a gaming device, the greater an amount of time which that gaming device is classified as in active status. It should be appreciated that a gaming machine is classified as active based on any one or more suitable parameters or criteria as determined by the implementer or operator of the gaming system.

Additionally, it should be appreciated that the gaming system disclosed herein contemplates other or additional methods for determining that a gaming machine is actively played to provide one or more shares. For instance, the player may be enabled to make a side wager or additional wager to be active for one or more subsequent share distribution events. The side wager feature could also be time based where the additional wager causes the gaming machine to be active for a subsequent time period, such as one minute. In another alternative embodiment, a minimum wager level is required for a gaming machine to qualify to participate in the share distribution event. In one embodiment, this minimum wager level is the maximum wager level for the primary game in the gaming machine. Another method for determining if the gaming machine is active is whether or not the player has wagered a minimum level of monetary units since the occurrence of the last share distribution event.

In another embodiment, it is contemplated for gaming system 70 to provide mystery shares to one or more of gaming devices 10*a* to 10*j* upon the bonus pool payout. In one embodiment, the determination to provide one or more mystery shares to a player actively playing a gaming device is based on that player's status (determined through a suitable player tracking system). In different embodiments, the determination to provide one or more mystery shares to one or more players is predetermined, randomly determined, determined based on a random determination by the central controller, determined based on a random determination at the gaming machine, determined based on one or more side wagers placed, determined based on the player's primary game wager, determined based on time (such as the time of day) or determined based on any other suitable method or criteria. In one example, to reward the triggering gaming device 10*a* to 10*j*, a plurality of mystery shares can be distributed, which would be paid over and above the amount distributed from the bonus pool and share distribution.

In one embodiment, a plurality of or each of the mystery shares have the same or substantially the same price per share as the current price per share. In another embodiment, a plurality of or each of the mystery shares are provided with a different price per share than the remaining outstanding shares. In different embodiments, the price per share for one or more mystery shares is predetermined, randomly determined, determined based on one or more player's status (determined through a suitable player tracking system), determined based on a random determination by the central controller, determined based on a random determination at the gaming machine, determined based on one or more side wagers placed, determined based on the player's primary game wager, determined based on time (such as the time of day) or determined based on any other suitable method or criteria. It should be appreciated that utilizing one or more mystery shares can account for any rounding issues described above.

In another embodiment, the gaming system provides promotional shares to one or more of gaming devices upon a share providing event. In one such embodiment, one or more of these promotional shares can each be redeemed for non-redeemable credits. In this embodiment, since these promotional shares are redeemable for game play credits (and cannot be redeemed for credits which can be immediately cashed out), the gaming system is operable to provide an increased amount in the bonus pool (and thus each promotional share is associated with a greater value of non-redeemable credits). In different embodiments, the determination to provide one or more promotional shares to one or more players is predetermined, randomly determined, determined based on a random determination by the central controller, determined based on a random determination at the gaming machine, based on that player's status (determined through a suitable player tracking system), determined based on one or more side wagers placed, determined based on the player's primary game wager, determined based on time (such as the time of day) or determined based on any other suitable method or criteria. In different embodiments, the number of non-redeemable credits associated with each promotional share is predetermined, randomly determined, determined based on a random determination by the central controller, determined based on a random determination at the gaming machine, based on that player's status (determined through a suitable player tracking system), determined based on one or more side wagers placed, determined based on the player's primary game wager, determined based on time (such as the time of day) or determined based on any other suitable method or criteria. It should be appreciated that in one embodiment utilizing promotional shares, the gaming system includes a plurality of different classes of shares, such as one class with promotional shares and another class with normal or regular shares.

In one embodiment, the gaming system includes a plurality of different classes of shares. In this embodiment, different shares in different classes are associated with different attributes or characteristics. For example, shares in a first class are each associated with a greater portion of the bonus pool (per outstanding share) than shares in a second class. In another example, shares in a first class may be stored for up to a designated period of time (in association with a player tracking system) while shares in a second class may not be stored (or may be stored for up to a second, different period of time).

In one embodiment, the gaming system provides shares of different classes to different groups of gaming devices. For example, a first group of gaming devices associated with a progressive award may be associated with a first class of shares and a second group of gaming devices not associated with any progressive awards may be associated with a second, different class of shares. In another embodiment, the gaming system provides shares of different classes to different types of gaming devices. For example, a first type of gaming devices, such as slot gaming devices, may be associated with a first class of shares and a second type of gaming devices, such as poker gaming devices, may be associated with a second, different class of shares. In another embodiment, the gaming system provides shares of different classes for different denominations played. In another embodiment, the gaming system provides shares of different classes to players of different player tracking levels.

In one embodiment, the gaming system enables players to transfer or exchange shares of different classes. In one such embodiment, to equate for different shares in different classes having different attributes or characteristics, the gaming system provides for shares to be exchanged at different ratios. For example, 10 shares of a first class associated with a player of a high player tracking status may be exchanged for 20 shares of a second class associated with a player of a low player tracking status. In another such embodiment, the gaming system enables player to exchange shares of different classes based on a one-to-one ratio. For example, 10 shares of a first class associated with a player of a high player tracking status may be exchanged for 10 shares of a second class associated with a player of a low player tracking status.

After distributing the bonus pool in accordance with block 118, gaming system 70 according to sequence 100 next determines whether the player plays again, as determined in connection with diamond 120. If the player does not play again or cashes out using cashout button 38, sequence 100 ends as seen in connection with oval 122. If the player does play again as determined in connection with diamond 120, sequence 100 is repeated beginning at block 104.

As discussed above, in one embodiment the payout is in the form of a ticket, which is redeemed according to a bar-coded amount on the ticket. Tickets allow flexibility in payment, e.g., in fractions of a credit or factions of a dollar. In another embodiment, gaming device 10 pays credits into coin payout tray 40. Here, the total payout including the amount of the bonus shares is rounded to the nearest credit.

If an award distribution event or bonus pool payout event does not occur, gaming system 70 employing sequence 100 again determines whether the player plays again, as seen in connection with diamond 124. If the player plays again, sequence 100 is again repeated beginning at block 104. If the player does not play again, as determined in connection with diamond 124, the player cashes out. In this sequence, the gaming system 70 donates the player's unused shares to the remaining actively played gaming devices as seen in connection with block 126. That is, if a player stops playing a gaming device in the gaming system before a suitable award distribution event or bonus pool payout event occurs, any accumulated shares previously allocated to that player are forfeited by that player. In one embodiment, the gaming device displays to the player a separate screen to remind the player and/or enable the player to confirm that they are forfeiting any shares.

In different embodiments, as a player plays one or more games at a gaming device in the gaming system and/or when the player stops playing: (a) the player earns positive interest on their shares (i.e., the value associated with the player's shares gradually increase over a designated period of time); (b) the player gradually loses one or more shares over a designated period of time; (c) the player loses one or more shares at a designated point in time; (d) the value associated with the player's shares gradually decrease over a designated period of time (such as applying a negative interest rate to the player's shares); (e) the value associated with the player's shares decrease at a designated point in time; or (f) any combination thereof.

It is contemplated to donate the exiting player's unused shares in a number of alternative ways. In one embodiment, the donated shares are divided evenly and reallocated amongst the remaining actively played gaming devices in the gaming system, for example using fractions of shares in combination with fractional credit payouts. For example, if the player actively playing Game #1 (i.e., gaming device 10*a*) of FIG. 3 cashes out, that player's 1000 allocated shares are divided amongst the seven remaining actively played gaming devices such that each player is allocated 142 additional shares.

In another embodiment, each actively played gaming device receives its prorated portion of the exiting player's total share amount or value in the form of an increase in game credits. For example, if the player actively playing Game #1 (i.e., gaming device 10*a*) of FIG. 3 cashes out, that player's 1000 allocated shares are determined to have a value of $5,000 which is provided to the seven remaining actively played gaming devices as additional game credits.

In another embodiment, the exiting player's shares are simply extinguished or retired, while the total pool amount is maintained, thus leading to a higher price for the existing shares. For example, if the player actively playing Game #1 (i.e., gaming device 10*a*) cashes out, that player's 1000 allocated shares are extinguished and since the total pool of $50,000 is divided amongst 9,000 shares (formerly 10,000 shares), the price per each share increases from $5.00 to $5.56. It should be appreciated that updating share price or game credits instead of shares may be preferred so that shares may be maintained as whole numbers, while share price is divided into fractions of a credit. This is seen in connection with block 126. Eventually, sequence 100 ends, as seen in connection with oval 122.

Referring now to FIG. 5, gaming system 70 performs an alternative sequence 140. For convenience, the sequence steps that have changed and certain surrounding steps for illustrating the changed steps are shown. The remaining non-changing steps of sequence 100 are not shown but are incorporated herein by reference. Each of the alternative embodiments and all the description associated with the non-illustrated steps is incorporated into sequence 140. The primary difference of sequence 140 occurs when a bonus pool payout triggering event has not occurred, as determined in connection with diamond 116. Again, if a bonus pool payout triggering event occurs in the base game of one of the active constituent gaming devices, gaming system 70 employing sequence 140 distributes the bonus pool to the actively played gaming devices according to their proportionate shares, amount of the pool, mystery shares, etc., as seen in connection with block 118. Afterwards, if the player wishes to play again, as determined in connection with diamond 120, sequence 140 proceeds to the sequence step of block 104 of sequence 100. If the player does not play again, as determined in connection with diamond 120, sequence 140 ends as seen in connection with oval 122.

Sequence 140 enables any player of any actively played gaming device 10*a* to 10*j* having any number of shares of a bonus pool to transfer the player's shares to another actively played gaming device, as seen in connection with diamond 128. In one implementation the transfer is free to the transferee. In this embodiment, if one player stops playing one gaming device, that player can designated a specific one of the other players to receive their shares, at no cost to either player. In another implementation, the transfer is not free to the transferee. In this example, one or more transferee's pay a fee or fraction of the share price for some or all of the transferor's shares. For example, the receiving players can pay a portion of the share, price, e.g., one-tenth, one-quarter or one-half the share price, for some or all of the exiting player's shares. In different embodiments, the fee to the transferee is predetermined, randomly determined, determined based on one or more player's status (determined through a suitable player tracking system), determined based on a random determination by the central controller, determined based on a random determination at the gaming machine, determined based on one or more side wagers placed, determined based on the player's primary game wager, determined based on time (such as the time of day) or determined based on any other suitable method or criteria.

In another embodiment, an auction is held with the shares going to the highest bidder. In this embodiment, display device 16 or 18 or overhead display 68 enables the transferor machine to post the player's desire to transfer some or all bonus shares. Interested buyers purchase the available shares on a first come, first served basis or via an auction held locally on display devices 16 or 18 of the participating gaming devices 10 or remotely on overhead display 68. It is also contemplated that players looking to convert coins to shares can also post a message asking for interested transferors, e.g., at a fixed, proposed or auctioned price per share. The exiting player in this way receives some benefit from the shares. In one embodiment, any player actively playing a gaming device may participate in the auction. In another embodiment, some but not all of the players actively playing gaming devices may participate in the auction. In different embodiments, the determination of whether a player is enabled to participate in the auction is predetermined, randomly determined, determined based on that player's status (determined through a suitable player tracking system), determined based on a random determination by the central controller, determined based on a random determination at the gaming machine, determined based on one or more side wagers placed, determined based on the player's primary game wager, determined based on time (such as the time of day) or determined based on any other suitable method or criteria.

In any event, if the player does not wish to transfer shares, as determined in connection with diamond 128, sequence 140 next determines whether the player plays again, as determined in connection with diamond 124. As described above in connection with sequence 100, if the player does not wish to play again, the player loses his or her unused shares and gaming system 70 updates the active player's shares or price per share on a prorated basis, as described above and seen in connection with block 126. Depending on the type of transfer, share price may or may not change. If the transfer is voluntary and the transferee pays nothing for the transfer, then the share transfer is done without any corresponding change in price. Otherwise, according to block 126 of sequence 100, there can be: (i) a transfer of shares at the current price; (ii) a transfer of shares to credits, leading to a decrease in the pool amount and an unchanged share price; or (iii) an extinguishing of the shares, an unchanged pool amount and a corresponding increase in share price.

If the transfer comes at a cost to the transferee, but no transfer takes place before cashout, the shares and corresponding portion of the pool are extinguished or retired upon a player cashout. Here, donation shares upon a cashout would de-incentivize players from paying for shares knowing that they can obtain a portion of the shares for free.

In one embodiment, sequence 140 for the exiting gaming device ends, as seen in connection with oval 122. If the player wishes to play again, as determined in connection with diamond 120, sequence 140 returns to the step illustrated in connection with block 104 of sequence 100.

If the player transfers the player's shares, as determined in connection with diamond 128, the shares are transferred to another one or more gaming device 10, as seen in connection with block 130. In one embodiment, any player actively playing a gaming device may be transferred one or more shares. In another embodiment, some but not all of the players actively playing gaming devices may be transferred one or more shares. In different embodiments, the determination of whether a player may be transferred one or more shares is predetermined, randomly determined, determined based on that player's status (determined through a suitable player tracking system), determined based on a random determination by the central controller, determined based on a random determination at the gaming machine, determined based on one or more side wagers placed, determined based on the player's primary game wager, determined based on time (such as the time of day) or determined based on any other suitable method or criteria.

In one embodiment, the transfer is made via an address assigned to each gaming device 10*a* to 10*j* of gaming system 70. Using link 58, the respective control units 60 of the transferring and transferee gaming devices perform the transfer. A notification is also sent to server 56, so that large overhead display 68 can be updated accordingly.

It is contemplated that a partial transfer of shares can take place via sequence 140. In this embodiment, a player wishes to keep playing and maintain some bonus shares while converting others to game credits (via a transfer). It is also possible that the transferor can transfer a portion of that player's shares to multiple recipients.

In one embodiment, the transferor voluntarily transfers shares to one or more players, who receives the shares at no cost. Here, display device 16 or 18 of the transferor gaming machine in one embodiment displays a transfer screen, which prompts the transferor to input the address of the gaming machine(s) to which a partial or total transfer is to be made. For example, each gaming device 10*a* to 10*j* when active can have an associated lighted number, for example numbers one to ten, which is readily viewable to all player's of gaming system 70. Here, the player enters the number of the gaming device to which the partial or total transfer is to be made. The transfer screen can also prompt the player as to how much of the player's shares to transfer to each gaming machine if this option is provided. Transfer screen can also prompt the player to transfer a second amount to a second gaming machine if only a partial transfer is made to a first transferring gaming machine.

In one embodiment, shares are transferred in one embodiment as whole numbers of shares for accounting purposes. In one embodiment, fractions of a share can not be transferred, although share price can be in fractions of a coin or dollar.

After the share transfer takes place as seen in connection with block 130, sequence 140 determines whether the player wants to play again, as determined in connection with diamond 120. If not, the sequence ends as seen in connection with oval 122. If the player does wish to play again, sequence 140 returns to the step 104 of sequence 100.

In one embodiment, one or more players are enabled to purchase shares from the gaming system. In another embodiment, one or more players are enabled to purchase special shares (i.e., shares which may be redeemed for non-redeemable credits) from the gaming system. In one embodiment, any player actively playing a gaming device may purchase one or more shares. In another embodiment, some but not all of the players actively playing gaming devices may purchase one or more shares. In different embodiments, the determination of whether a player may purchase one or more shares is predetermined, randomly determined, determined based that player's status (determined through a suitable player tracking system), determined based on a random determination by the central controller, determined based on a random determination at the gaming machine, determined based on one or more side wagers placed, determined based on the player's primary game wager, determined based on time (such as the time of day) or determined based on any other suitable method or criteria.

In one embodiment, one or more players pay a fee equal or substantially equal to the current price per share for each purchased share. In another embodiment, one or more players pay a fee greater than the current price per share for each purchased share. In this embodiment, players pay a premium to purchase each share. In another embodiment, one or more players pay a fee lower than the current price per share for each purchased share. In one such embodiment, the gaming system enables players of a certain player status to purchase one or more shares at a discount to the current price per share. In another such embodiment, the gaming system enables players who purchase a designated quantity of shares to purchase the designated quantity of shares at a discount to the current price per share. In different embodiments, the amount or value that each player pays for each purchased share is predetermined, randomly determined, determined based on one or more player's status (determined through a suitable player tracking system), determined based on a random determination by the central controller, determined based on a random determination at the gaming machine, determined based on one or more side wagers placed, determined based on the player's primary game wager, determined based on time (such as the time of day) or determined based on any other suitable method or criteria.

In one embodiment, if a player buys one or more shares, the purchased shares are associated with a designated rate of play. In this embodiment, if the player does not play games at the designated rate of play, these purchased shares are forfeited. In another embodiment, if a player buys one or more shares, the player must pay a fee or commission to a gaming establishment for the purchased shares.

Referring now to FIG. 6, gaming system 70 can run a further alternative sequence illustrated by sequence 150. In sequence 150, gaming system 70 again determines whether an award distribution event or bonus pool payout triggering event has occurred in connection with diamond 116. If an award distribution event or a bonus pool payout triggering event has occurred, gaming system 70 distributes the bonus pool to the gaming devices according to proportionate shares, the pool amount, price per share, mystery shares, etc., as described above and seen in connection with block 118. Next, or in the case in which an award distribution event or a bonus pool payout triggering event has not occurred, gaming system 70 employing sequence 150 determines whether the player plays again, as seen in connection with diamond 120. If the player decides to play again, sequence 150 returns to step 164 shown of system 100.

If the player decides not to play again, as determined in connection with diamond 120, the player cashes out, as shown in connection with block 132. Here, the respective gaming device 10 pays the player any credits remaining on credit meter 20 as well as a fraction or whole of any of the player's bonus shares. In one embodiment, the payout is made on a ticket with fractional credits, which enables partial credits to be paid for example as cents on a dollar credit.

If the player receives the full amount for the shares, no corresponding increase in shares is enjoyed by the remaining actively played gaming devices. If less than the full amount is paid out, remaining players benefit from the leftover amount in any of the ways discussed above in connection with block 126, e.g., in the form of shares, credits or share price increase. In sequence 150, the remaining actively played gaming machines may not therefore benefit from an actively played gaming device cashing out before a bonus pool payout is made. The player receives at least some benefit from the shares the player has accrued during gaming activity. The transfer option shown in connection with sequence 140, e.g., in the voluntary form, may also be provided in connection with sequence 150.

Figure 7:
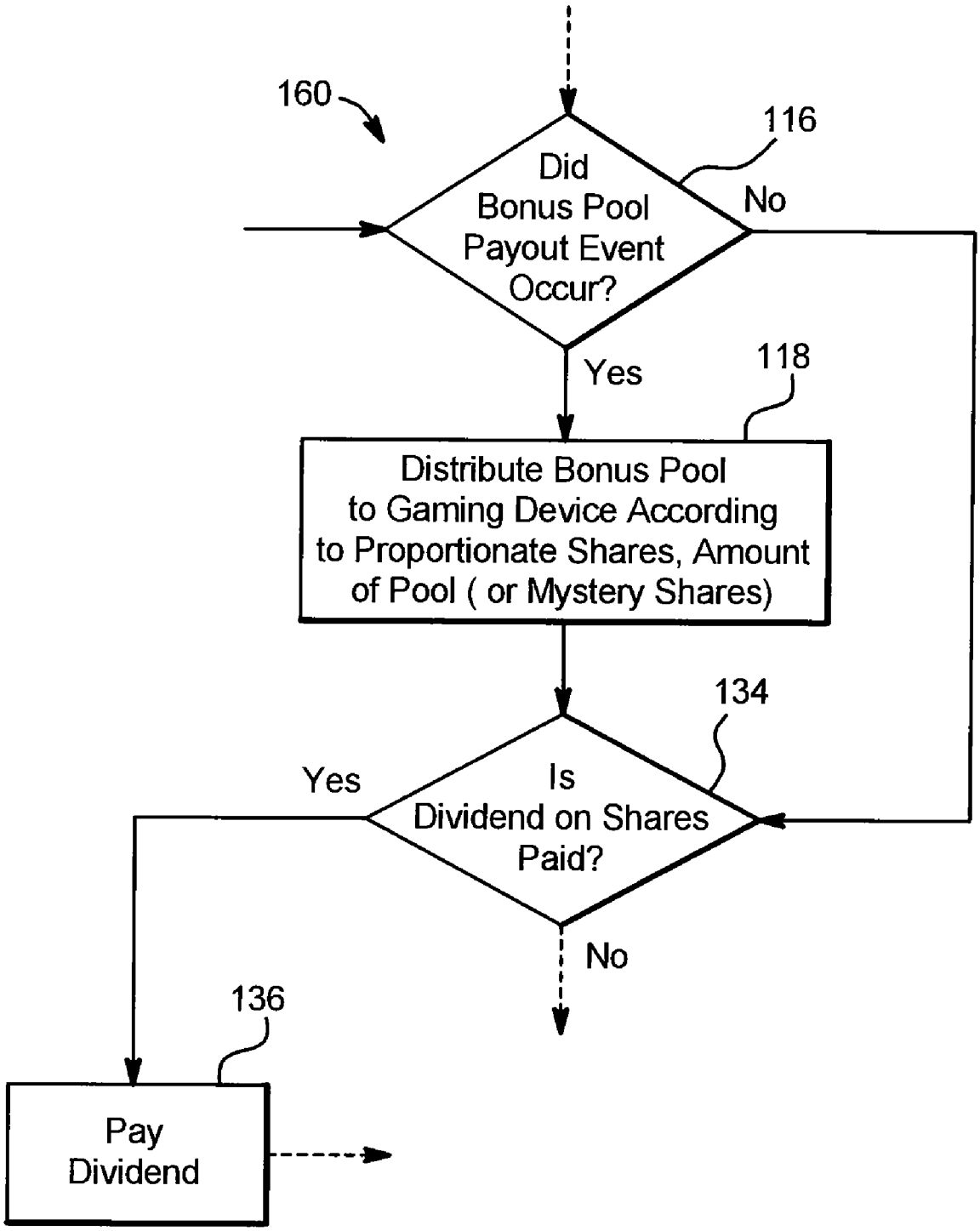
FIG. 7 is a schematic block diagram of a further alternative sequence of operation for a gaming system having award distribution using shares according to the present disclosure.

Referring now to FIG. 7, a further alternative sequence for gaming system 70 as illustrated by sequence 160. Each of the steps and applicable alternatives described above in connection with systems 100, 140 and 150 are incorporated into sequence 160. Here, an option shown in connection with diamond 134 is to provide an additional bonus in the form of a dividend paid on the shares of one or more or each of the actively played gaming devices. The additional bonus can be paid regardless of whether a bonus pool payout triggering event has occurred, as determined in connection with diamond 116, and be distributed to one or more players according to the disclosure in connection with block 118 provided herein, e.g., according to a player's number of shares, measuring players with more shares receive a higher dividend.

If a dividend is paid, as determined in connection with diamond 134, gaming system 70 pays the dividend to the one or more actively played gaming devices, as seen in connection with block 136. Afterwards, sequence 160 precedes according to any of the sequences 100, 140 and 150 discussed above.

In one embodiment, the dividend is based on the number of shares that the player has. For example, the dividend can be a credit for each share that the player has. In another embodiment, the dividend is a fraction or multiple of a credit per each of the player's shares. In another embodiment, the dividend is a promotional credit, such as a non-redeemable game play credit. In different embodiments, the amount or value of each dividend is predetermined, randomly determined, determined based on one or more player's status (determined through a suitable player tracking system), determined based on a random determination by the central controller, determined based on a random determination at the gaming machine, determined based on one or more side wagers placed, determined based on the player's primary game wager, determined based on time (such as the time of day) or determined based on any other suitable method or criteria.

In one embodiment, the dividend or additional bonus is paid to only a single gaming device, for example, for achieving a particular payout combination. Alternatively, as with the shared bonus pool, the dividend can be paid to each of the constituent gaming devices, for example, to one of the gaming devices achieving a particular symbol combination. Alternatively, if the actively played gaming devices as a whole perform at particular level, the dividend or additional bonus is paid out over the entire group of gaming devices. In different embodiments, which players at which gaming devices are paid a dividend is predetermined, randomly determined, determined based on one or more player's status (determined through a suitable player tracking system), determined based on a random determination by the central controller, determined based on a random determination at the gaming machine, determined based on one or more side wagers placed, determined based on the player's primary game wager, determined based on time (such as the time of day) or determined based on any other suitable method or criteria.

In one embodiment, one or more of the dividends are funded, at least in part, by the wagers placed by the players at the gaming devices of the gaming system. In another embodiment, one or more of the dividends are funded, at least in part, by the primary game paytable associated with one or more of the gaming devices in the gaming system. In another embodiment, one or more of the dividends are funded, at least in part, by one or more side bets or side wagers placed. In another embodiment, one or more of the dividends are funded, at least in part, by a gaming establishment, such as a casino's marketing department.

In another embodiment, the gaming system provides one or more dividends to the award or bonus pool. In different embodiments, the determination of whether to provide a dividend to the award or bonus pool is predetermined, randomly determined, based on a player's status (such as determined through a player tracking system), based on time, based on a random determination by the central controller, based on a random determination at the gaming machine, based on one or more side wagers placed or based on any other suitable method or criteria.

In one alternative embodiment, the gaming system provides to players one or more shares which are each associated with a strike price. In one embodiment, the associated strike price is set regardless of any fluctuations in the price of the share. In this embodiment, upon a bonus pool payout event occurring, the gaming system provides each player who holds a share associated with a strike price an award based on the current value of the share minus the strike price. In one embodiment, different shares are associated with different strike prices at different points in time. For example, if the strike price associated with a first set of shares provided at a first point in time is lower than the strike price associated with a second set of shares provided at a second, subsequent point in time (i.e., the strike prices associated with provided shares increase over time), then when the bonus pool payout event occurs, any players who are provided shares from the first set (with a lower strike price) are provided a greater payout than the player who are provided shares from the second set. In different embodiments, the strike price associated with one or more shares is predetermined, randomly determined, determined based on the player's status (such as determined through a player tracking system), determined based on time, determined based on a random determination by the central controller, determined based on a random determination at the gaming machine, determined based on one or more side wagers placed or determined based on any other suitable method or criteria.

In another alternative embodiment, the gaming system modifies the number of shares provided to one or more players. In one embodiment, the gaming system splits each outstanding share into a plurality of shares. In one embodiment, since the number of outstanding shares is modified, the price per share is also modified as described above. In another embodiment, the gaming system splits each outstanding share into a plurality of shares without modifying the price per share for each outstanding share. In another embodiment, the gaming system splits each outstanding share into a plurality of shares at a designated point in time. For example, one hour after a bonus pool event payout, the gaming system splits any shares that have been accumulated by players playing gaming devices in the gaming system. This embodiment provides additional incentive to players to play gaming devices of the gaming system immediately after a bonus pool event payout occurs (i.e., when the bonus pool is reset to a default value). In different embodiments, the determination to modify a player's number of shares is predetermined, randomly determined, determined based on the player's status (such as determined through a player tracking system), determined based on time, determined based on a random determination by the central controller, determined based on a random determination at the gaming machine, determined based on one or more side wagers placed or determined based on any other suitable method or criteria.

In another embodiment, the gaming system enables a player to instruct the gaming system sell one or more of the player's shares at a subsequent point in time. For example, a player may instruct the gaming system to cash out or redeem a plurality of shares in two weeks. In this example, two weeks from when the instructions are input, the gaming system executes the instructions, sells the player's shares and enables the player access to the proceeds from the sale. In another embodiment, the gaming system enables a player to instruct the gaming system to sell one or more of the player's shares upon the occurrence of an event. For example, a player may instruct the gaming system to cash out or redeem a plurality of shares when the price per share increases to a designated price or decreases to a designated price. In this example, upon the price per share reaching the designated price, the gaming system executes the instructions, sells the player's shares and enables the player access to the proceeds from the sale. In another embodiment, the gaming system enables a player to purchase insurance against the value or price of one or more shares decreasing. In this embodiment, if the insurance is purchased and a player's shares decrease a designated amount in value, the gaming system provides the player with an amount or value to compensate the player for the decreased share price.

In another embodiment, the gaming system includes a plurality of bonus pools. In one embodiment, each bonus pool is individually associated with an independent set of shares as described above. In another embodiment, the outstanding shares in the gaming system are each associated with each of the plurality of bonus pools. In one embodiment, if a player is selling or redeeming one or more of their shares, the gaming system randomly pick one of the bonus pools to associate their shares with. In one such embodiment, after determining the value of each share (based on the value of the picked bonus pool), the gaming system enables the player to accept or reject the offer for the shares (i.e., the gaming system enables the player to continue redeeming their shares or to hold their shares). In another embodiment, if a player is selling or redeeming one or more of their shares, the gaming system enables the player to pick one of the bonus pools to associate their shares with.

In another embodiment, one or more of the bonus pools are accumulated value pools as described above. In this embodiment, if an accumulated value pool increments to a hit value within a range associated with that pool, the gaming system enables one or more players to redeem their shares for that bonus pool. It should be appreciated that in this embodiment, the more players who decide not to redeem their shares when a smaller valued bonus pool is hit, increase the share price for the players that do redeem their shares when the smaller valued bonus pool is hit. Moreover, the more players who decide to redeem their shares when a larger valued bonus pool is hit, decreases the share price for each of such players.

Figure 8:
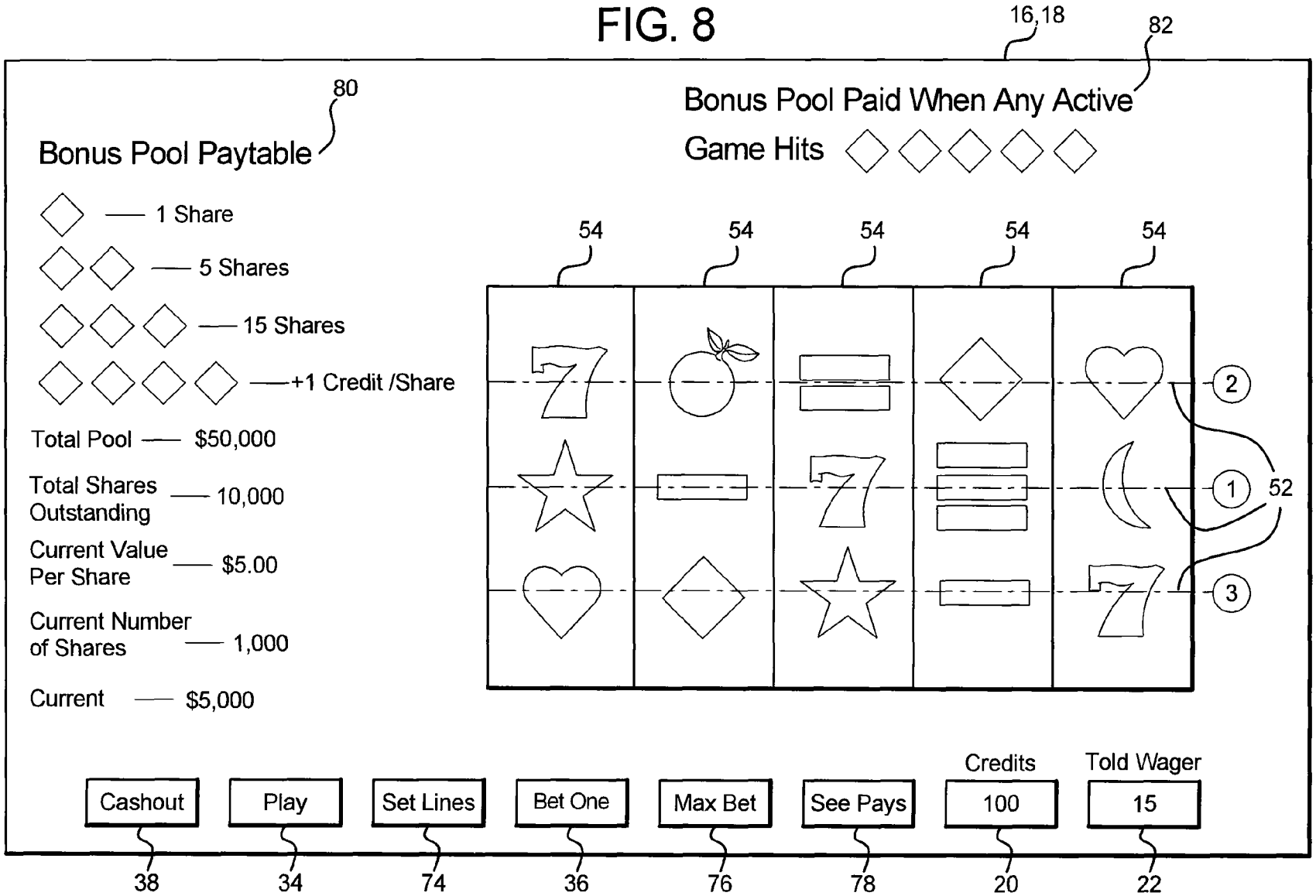
FIG. 8 is an elevation view of one embodiment of a gaming device screen showing award distribution using shares according to the present disclosure.

Referring now to FIG. 8, an example gaming screen of one of the gaming devices 10 of gaming system 70 is illustrated on video screen 16 or 18. Video screen 16 or 18 as discussed above operates with a touch screen overlay 42, which is controlled via touch screen controller 44 in cooperation with one or more gaming device processors. In FIG. 8, any of the components discussed above are shown, such as a slot game having paylines, e.g., three paylines 52, reels, such as five reels 54, cashout button 38, play button 34, bet one button 36, credit meter 20 and total bet display 22. Additionally, the multi-payline slot game includes a set paylines button 74, a max bet button 76 and a see pays button 78. Set paylines button 74 works in combination with wager per payline or bet one button 36, to enable the player to select a number of paylines to play and a number credits to wager per payline. Max bet button 76 automatically wagers the maximum number of credits on each of the available paylines 52. For example, in the three payline game, if the maximum wager per payline is five credits, the maximum bet is fifteen credits, as shown in bet display 22.

Video monitor 16 or 18 also shows a bonus pool paytable 80 and an audio, video or audio video bonus pool triggering message 82. Bonus pool paytable 80 sets forth how the player of a particular gaming device increases shares. For example, if the player receives a single diamond on the left most reel 54, the player receives one share. If the player receives two diamonds in the first and second left most reels 54 the player receives five shares. If the player receives three diamonds on reels one, two and three, the player receives fifteen shares, and so on. In this embodiment, as each additional share is issued, that share is entered into the total number of shares outstanding for each of the gaming devices of the gaming system. As described above, as the outstanding number of shares changes, the price per share is then redistributed. It should be appreciated that even though the price per share may go down slightly, the player will have a net overall increase in balance due to the additional shares. Bonus pool paytable 80 also illustrates that a price per share increase occurs for obtaining four diamonds on the first four reels along any active payline.

Bonus pool triggering message 82 indicates that the bonus pool is paid when any actively played gaming device receives five diamonds on reels 54 along any active payline. It should be appreciated that while slot is one preferred base game, the bonus pool paytable 80 and bonus triggering combination can be configured for other suitable base wagering games. As discussed above, other gaming features can be used to increase shares or price per share or to trigger the bonus pool payout. Such features include, but are not limited to, total wagers, total lost, total won, playing time, number of plays.

Video screen 16 or 18 also shows the total bonus pool amount, the total outstanding shares for all gaming machines, the current value per share, the current number of shares for the associated gaming device and the current total value of the bonus pool for the associated gaming device. Each of the numbers is also shown on large overhead display 68 as discussed above.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a plurality of gaming devices, each gaming device including:

at least one display device, at least one input device;

at least one processor; and at least one memory device which stores a plurality of instructions, which when executed by the at least one processor, causes the at least one processor to operate with the at least one input device and the at least one display device to enable a player to play a base game upon a wager; and a controller programmed to operate with the plurality of gaming devices, said controller programmed to:

(a) before a random occurrence of an award distribution triggering event, for at least one actively played gaming device of the plurality of gaming devices:

(i) randomly determine whether to distribute a number of shares of a bonus pool, said random determination of whether to distribute said number of shares being separate from the random occurrence of the award distribution triggering event, and (ii) if the random determination is to distribute the number of shares of the bonus pool, distribute said number of shares of the bonus pool to said actively played gaming device;

(b) before the random occurrence of the award distribution triggering event, nullify shares distributed to the gaming devices that become non-actively played; and (c) upon the random occurrence of the award distribution triggering event, cause each gaming device to make a distribution of the bonus pool according to an amount of the bonus pool and currently distributed, non-nullified shares of said gaming device.

2. The gaming system of claim 1, wherein the bonus pool is funded through each play of the base game by each actively played gaming device.

3. The gaming system of claim 1, wherein the bonus pool is funded by taking a portion of the wager made by each actively played gaming device to play the base game.

4. The gaming system of claim 1, wherein, before the random occurrence of the award distribution event, the controller is programmed to determine the number of shares to distribute to one of the actively played gaming devices based, at least in part, on at least one of:

(i) an amount of time playing the gaming device;
(ii) an amount of money wagered at the gaming device;
(iii) an amount of money lost at the gaming device;
(iv) an amount of money won at the gaming device;
(v) randomly and independently of play of the base game of the gaming device; and
(vi) upon an event or outcome occurring in the base game of the gaming device.

5. The gaming system of claim 1, wherein the controller is programmed to determine when to distribute the bonus pool based, at least in part, on at least one of:

(i) a random time of day;
(ii) an amount of money lost collectively at the actively played gaming devices;
(iii) an amount of money won collectively at the actively played gaming devices;
(iv) upon an event or outcome occurring in the play of the base game of one of the actively played gaming devices; and
(v) upon an event occurring due to a shared random outcome generation.

6. The gaming system of claim 1, wherein the controller is programmed to distribute the bonus pool to each actively played gaming device by dividing a total amount of the pool by a total number of distributed, non-nullified shares to form a share price and then to multiply the share price by a total number of distributed, non-nullified shares for each of the actively played gaming device.

7. The gaming system of claim 1, wherein the controller is programmed to enable the player to redeem a number of distributed, non-nullified shares upon cashing out.

8. The gaming system of claim 1, wherein the controller is programmed to enable the player of a first one of the plurality of gaming devices to transfer at least one distributed, non-nullified share to a second one of the plurality of gaming devices.

9. The gaming system of claim 8, wherein the transfer includes at least one characteristic selected from the group consisting of:

(i) being a sale of the at least one distributed, non-nullified share from the first gaming device to the second gaming device;
(ii) occurring according to a solicitation from the first or second gaming device; and
(iii) being a gift from the first gaming device to the second gaming device.

10. The gaming system of claim 1, which includes a display configured to display at least one of:

(i) a total amount of the bonus pool;
(ii) a total number of distributed, non-nullified shares;
(iii) an amount per distributed, non-nullified share;
(iv) a number of distributed, non-nullified shares belonging to at least one of the actively played gaming devices; and
(v) a total amount of the distributed, non-nullified shares belonging to the at least one actively played gaming device.

11. The gaming device system of claim 10, wherein the display is provided on at least one of: (i) the at least one display device dedicated to one of the plurality of gaming devices; and (ii) a display device shared by at least two of the plurality of gaming devices.

12. A gaming system comprising:

a controller programmed to:
(i) before a random occurrence of an award distribution triggering event, randomly determine whether to distribute a number of shares of a bonus pool, said random determination of whether to distribute the number of shares being separate from the random occurrence of the award distribution triggering event and
(ii) if the random determination is to distribute the number of shares of the bonus pool, distribute the number of shares of the bonus pool; and a plurality of gaming devices operable to communicate with the controller, wherein each gaming device includes:
at least one display device,
at least one input device,
at least one processor, and
at least one memory device which stores a plurality of instructions, which when executed by the at least one processor, causes the at least one processor to operate with the at least one input device and the at least one display device to:
(a) enable a player to play a game upon a wager, and
(b) display, before the random occurrence of the award distribution triggering event:
(i) a total value of the bonus pool common to the plurality of gaming devices;
(ii) a number of shares distributed to the gaming device at a first point in time; and
(iii) a total value of the shares distributed to the gaming device.

13. The gaming system of claim 12, wherein for each gaming device, when the plurality of instructions are executed by the at least one processor of said gaming device, said at least one processor causes the at least one display device of said gaming device to display at least one of: (i) a total number of distributed shares of the bonus pool; and (ii) a value per distributed share.

14. The gaming system of claim 12, wherein for each gaming device, when the plurality of instructions are executed by the at least one processor of said gaming device, said at least one processor causes the at least one display device of said gaming device to display items (i) to (iii) only when the gaming device is actively played.

15. The gaming system of claim 12, wherein the controller is programmed to nullify at least one share of any of the gaming devices becoming inactively played such that a total number of shares is reduced and the total value of the shares displayed is increased.

16. The gaming system of claim 15, wherein for each gaming device, when the plurality of instructions are executed by the at least one processor of said gaming device, said at least one processor causes the at least one display device of said gaming device to show at least one of: (i) a base game played in combination with the bonus pool; (ii) the total value of the bonus pool and the total value of the shares distributed to the gaming device increasing periodically; and (iii) an event causing the bonus pool to be distributed to actively played gaming devices of the gaming system.

17. A method of operating a gaming system, said method comprising:

(a) maintaining a bonus pool, said bonus pool having a value;

(b) before a random occurrence of a triggering event, for actively played gaming devices:

(i) randomly determining whether to provide a number of shares of the bonus pool, wherein each actively played gaming device includes at least one base game operable upon a wager by a player said random determination of whether to provide said number of shares being separate from the random occurrence of the triggering event, and (ii) if the determination is to provide the number of shares of the bonus pool, providing said number of shares to the actively played gaming devices;

(c) before the occurrence of the random triggering event, nullifying shares provided to the gaming devices that become non-actively played; and (d) upon the random occurrence of the triggering event, enabling at least one of the players to redeem at least one of the currently provided, non-nullified shares, wherein an amount paid out for each redeemed share is based on the number of provided, non-nullified shares and the value of the bonus pool.

18. The method of claim 17, wherein maintaining the bonus pool includes funding the pool progressively.

19. The method of claim 17, wherein providing a number of non-nullified shares to the actively played gaming devices occurs individually on a gaming device by gaming device basis.

20. The method of claim 17, wherein the random occurrence of the triggering event is based, at least in part, on at least one of: (i) a random time of day; (ii) an amount of money lost collectively at the actively played gaming devices; (iii) an amount of money won collectively at the actively played gaming devices; (iv) upon an event or outcome occurring in the base game of one of the actively played gaming devices; and (v) upon an event occurring due to a shared random outcome generation.

* * * * *

UNITED STATES PATENT AND TRADEMARK OFFICE

CERTIFICATE OF CORRECTION

PATENT NO. : 7,789,755 B2
APPLICATION NO. : 11/556940
DATED : September 7, 2010
INVENTOR(S) : Davis et al.

It is certified that error appears in the above-identified patent and that said Letters Patent is hereby corrected as shown below:

In Claim 14, Column 40, Line 47, replace "items (i) to (iii) only" with --items (b)(i) to (b)(iii) only--.

In Claim 17, Column 41, Line 6, replace "player said" with --player, said--.

Signed and Sealed this

Thirtieth Day of November, 2010

David J. Kappos

David J. Kappos
*Director of the United States Patent and Trademark Office*